US012446663B2

(12) United States Patent
Andreasen et al.

(10) Patent No.: US 12,446,663 B2
(45) Date of Patent: Oct. 21, 2025

(54) TENSIONING SYSTEM FOR ARTICLE OF FOOTWEAR

(71) Applicant: NIKE, Inc., Beaverton, OR (US)

(72) Inventors: Lindsey K. Andreasen, Beaverton, OR (US); YongSeon Lee, Hochiminh (VN); Austin J. Orand, Portland, OR (US); Jessica Small, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 316 days.

(21) Appl. No.: 17/166,544

(22) Filed: Feb. 3, 2021

(65) Prior Publication Data

US 2021/0235819 A1 Aug. 5, 2021

Related U.S. Application Data

(60) Provisional application No. 62/970,136, filed on Feb. 4, 2020.

(51) Int. Cl.

| | |
|---|---|
| ***A43C 11/20*** | (2006.01) |
| ***A43B 23/26*** | (2006.01) |
| ***A43C 7/08*** | (2006.01) |

(52) U.S. Cl.

CPC ..... *A43C 11/20* (2013.01); *A43B 23/26* (2013.01); *A43C 7/08* (2013.01)

(58) Field of Classification Search

CPC ..... A43C 11/20; A43C 7/08; A43C 11/16; A43C 11/18; A43C 7/02; A43C 1/006; A43C 11/1406; A43C 11/165; A43C 7/00; A43B 23/26

See application file for complete search history.

(56) References Cited

U.S. PATENT DOCUMENTS

| | | | | |
|---|---|---|---|---|
| 4,807,333 A * | 2/1989 | Boden | A63C 10/06 24/136 R |
| 4,884,321 A * | 12/1989 | Holub | A43C 7/00 24/712.2 |
| 4,999,888 A * | 3/1991 | Miller | A43C 7/00 24/442 |

(Continued)

FOREIGN PATENT DOCUMENTS

| | | |
|---|---|---|
| CN | 102821635 A | 12/2012 |
| CN | 106687003 A | 5/2017 |

(Continued)

OTHER PUBLICATIONS

International Search Report for Application PCT/US2021/016432 dated May 7, 2021.

(Continued)

*Primary Examiner* — Katharine G Kane

(74) *Attorney, Agent, or Firm* — Bookoff McAndrews, PLLC.

(57) ABSTRACT

An article of footwear includes an upper and a cable lock disposed adjacent to an exterior surface of the upper. The cable lock is separated from the exterior surface of the upper by a space. The article of footwear also includes a cable having a first portion routed through the cable lock and a second portion routed through the space between the cable lock and the upper. The cable is operable to move the upper between a relaxed state and a constricted state.

12 Claims, 14 Drawing Sheets

(56) References Cited

U.S. PATENT DOCUMENTS 5,029,371 A * 7/1991 Rosenblood ..... A43B 3/0078 24/712.9
5,097,573 A * 3/1992 Gimeno ..... A43C 7/00 24/712.2
5,177,882 A * 1/1993 Berger ..... A43C 11/165 36/50.1
5,333,398 A * 8/1994 Seo ..... A43C 7/00 24/712.9
5,471,713 A * 12/1995 Alter ..... F16G 11/106 24/136 R
5,713,141 A 2/1998 Mitchell et al.
5,718,021 A * 2/1998 Tatum ..... A43C 7/04 24/712.2
5,952,065 A 9/1999 Mitchell et al.
6,582,786 B1 6/2003 Bonk et al.
6,817,070 B1 * 11/2004 Liu ..... A43C 7/00 24/712.9
2003/0075884 A1 4/2003 Bussiere
2004/0006856 A1 * 1/2004 Moreno ..... A43C 7/02 24/306
2004/0250388 A1 * 12/2004 Martin ..... A43C 7/08 24/712.5
2005/0172463 A1 * 8/2005 Rolla ..... A43C 7/02 24/712.1
2006/0000116 A1 * 1/2006 Brewer ..... A43C 5/00 36/11.5
2006/0179685 A1 * 8/2006 Borel ..... A43C 7/00 36/50.1
2015/0342304 A1 12/2015 Modena et al.
2015/0359296 A1 * 12/2015 Gulla ..... A43C 11/165 36/109
2016/0058130 A1 * 3/2016 Boney ..... A43B 3/36 24/712.6
2018/0020767 A1 1/2018 Dyer et al.
2018/0295943 A1 10/2018 Fallon et al.
2022/0333668 A1 * 10/2022 Piao ..... A44B 11/26

FOREIGN PATENT DOCUMENTS

CN 109862802 A 6/2019
DE 19945045 A1 3/2001
JP H07208 A 1/1995
KR 101977151 B1 5/2019

OTHER PUBLICATIONS

International Search Report and Written Opinion for Application PCT/US2021/016432, dated May 7, 2021.
Communication pursuant to Article 94(3) EPC, European Patent Application No. 21 709 198.2, date Apr. 15, 2024. (6 pages).
Chinese Office Action, Application No. 202180022013.7, issued Mar. 30, 2024. (pp. 10).

* cited by examiner

TENSIONING SYSTEM FOR ARTICLE OF FOOTWEAR

CROSS REFERENCE TO RELATED APPLICATION

This application claims priority under 35 U.S.C. § 119(e) to Provisional U.S. Patent Application No. 62/970,136, filed Feb. 4, 2020, the disclosure of which is hereby incorporated by reference in its entirety.

FIELD

The present disclosure relates generally to articles of footwear, and more particularly, to tensioning systems for articles of footwear.

BACKGROUND

This section provides background information related to the present disclosure, which is not necessarily prior art.

Articles of footwear conventionally include an upper and a sole structure. The upper may be formed from any suitable material(s) to receive, secure and support a foot on the sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may cooperate with laces, straps, or other fasteners to adjust the fit of the upper around the foot. For instance, laces may be tightened to close the upper around the foot and tied once a desired fit of the upper around the foot is attained. Care is required to ensure that the upper is not too loose or too tight around the foot each time the laces are tied. Moreover, the laces may loosen or become untied during wear of the footwear. While fasteners such as hook and loop fasteners are easier and quicker to operate than traditional laces, these fasteners have a propensity to wear out over time and require more attention to attain a desired tension when securing the upper to the foot.

Known automated tightening systems typically include a tightening mechanism, such as a rotatable knob, that can be manipulated to apply tension to one or more cables that interact with the upper for closing the upper around a foot. While these automated tightening systems can incrementally increase the magnitude of tension of the one or more cables to achieve the desired fit of the upper around the foot, they require a time-consuming task of manipulating the tightening mechanism to properly tension the cables for securing the upper around the foot. Further, when it is desired to remove the footwear from the foot, the wearer is required to simultaneously depress a release mechanism and pull the upper away from the foot to release the tension of the cables. Thus, known automated tightening systems lack suitable provisions for both quickly and variably adjusting the tension of the cables to close the upper around the foot and quickly releasing the tension applied to the cables so that the upper can be quickly loosened for removing the footwear from the foot.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled chamber to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a stroble attached to the upper and disposed between the midsole and the insole or sockliner.

Midsoles using fluid-filled chambers are generally configured as a chamber formed from two barrier layers of polymer material that are sealed or bonded together, and pressurized with a fluid such as air. Tensile members may be incorporated within the chamber to retain the shape of the chamber when the chamber compresses resiliently under applied loads, such as during athletic movements. Generally, fluid-filled chambers are designed with an emphasis on balancing support for the foot and cushioning characteristics that relate to responsiveness as the fluid-filled chamber resiliently compresses under an applied load. The fluid-filled chamber as a whole, however, fails to adequately dampen oscillations by the foot as the fluid-filled chamber compresses to attenuate ground-reaction forces. Accordingly, creating a midsole from a fluid-filled chamber that dampens foot oscillation and provides acceptable cushioning for the foot while attenuating ground-reaction forces is difficult to achieve.

DESCRIPTION OF THE DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
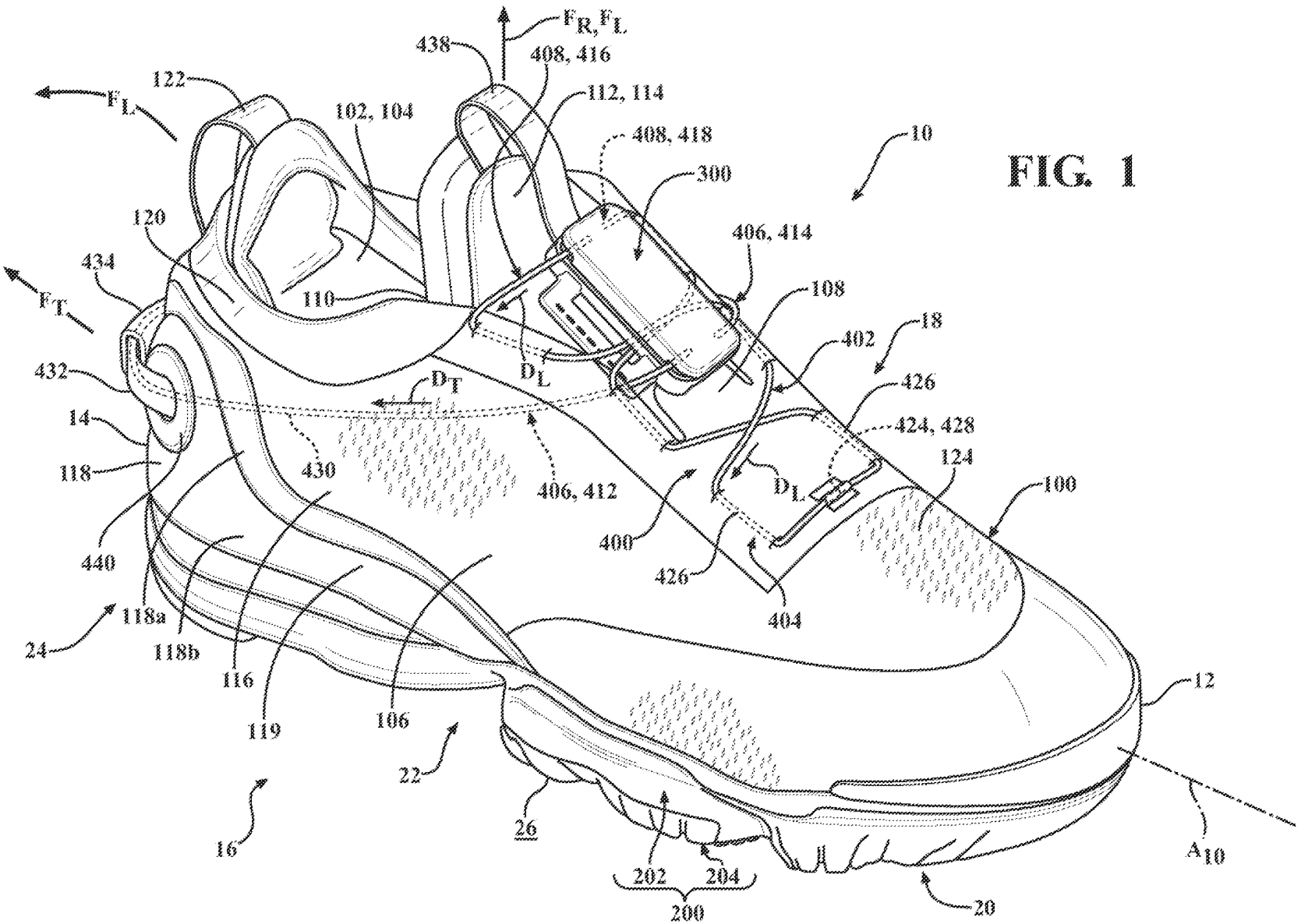
FIG. 1 is a top perspective view of an article of footwear including a cable lock and fastening system in accordance with principles of the disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another element, component, region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article of footwear. The article of footwear includes an upper and a cable lock disposed adjacent to an exterior surface of the upper. The cable lock is separated from the exterior surface of the upper by a space. The article of footwear also includes a cable having a first portion routed through the cable lock and a second portion routed through the space between the cable lock and the upper. The cable is operable to move the upper between a relaxed state and a constricted state.

Implementations of the disclosure may include one or more of the following optional features. In some implementations, the cable lock includes one or more legs extending therefrom, the cable lock supported against the upper by each of the one or more legs. Here, each of the legs may include a flange disposed against the upper. The flange of each of the one or more legs may be attached to the upper. Each of the legs may include an aperture formed therethrough. The aperture may be in communication with the space. The cable may be routed through the aperture of each of the one or more legs.

In some examples, the cable lock is disposed on a throat of the upper. The cable may include a control element and a fastening element, the control element extending from the cable lock and around a heel region of the article of footwear and the fastening element extending along a throat of the upper. The upper may include a release grip attached to a throat of the upper adjacent to an ankle opening, the release grip operable to move the cable lock from a locked state to an unlocked state.

Another aspect of the disclosure provides an article of footwear. The article of footwear includes an upper having an ankle opening and a tongue portion disposed adjacent to the ankle opening. The article of footwear also includes a cable lock disposed adjacent to the tongue portion of the upper and a cable having a first portion routed through the cable lock and a second portion routed through a space between the cable lock and the tongue portion. The cable is operable to move the upper between a relaxed state and a constricted state. The article of footwear also includes a release grip extending from the cable lock adjacent to the ankle opening and operable to move the cable lock from a locked state to an unlocked state.

Implementations of the disclosure may include one or more of the following optional features. In some examples, the cable lock includes one or more legs extending therefrom, the cable lock supported against the upper by each of the one or more legs to define the space between the cable lock and the upper. Optionally, each of the legs includes a flange disposed against the upper. Here, the flange of each of the one or more legs may be attached to the upper.

In some implementations, each of the legs includes an aperture formed therethrough. Optionally, the aperture is in communication with the space. In some examples, the cable is routed through the aperture of each of the one or more legs.

In some configurations, the cable lock is disposed on a throat of the upper. In some implementations, the cable includes a control element and a fastening element, the control element extending from the cable lock and around a heel region of the article of footwear and the fastening element extending along a throat of the upper. In some examples, the cable lock includes a release cord having a first end connected to the cable lock and a second end connected to the release grip.

Another aspect of the disclosure provides a cable lock for an article of footwear. The cable lock includes a cradle having a receptacle and one or more legs extending from the receptacle. The cable lock also includes a lock device removably received within the receptacle. The lock device is operable between an unlocked state to allow a cable to move through the lock device in a tightening direction and a loosening direction and in a locked state to prevent the cable from moving through the lock device in the loosening direction.

Implementations of this aspect of the disclosure may include one or more of the following optional features. In some configurations, the receptacle includes a bottom wall and one or more sidewalls, each of the one or more legs extending from the one or more sidewalls to a distal end beyond the bottom wall. Here, the distal end of each of the legs may include a flange. The flange may be parallel to and offset from the bottom wall of the receptacle. The one or more legs may include a pair of the legs disposed on opposite sides of the receptacle and defining a space along the bottom wall. Each of the legs may include an aperture in communication with the space.

In some implementations, the receptacle includes a chamber configured to receive the lock device, the chamber including a pair of shoulders upon which the lock device is supported. Here, the shoulders may be spaced apart from each other to define a channel extending between the lock device and an inner surface of the receptacle. The lock device may include a release cord operable to move the lock device from a locked state to an unlocked state, the release cord routed through the channel. Here, the cable lock may include a lid configured to enclose the lock device within the receptacle.

The details of one or more implementations of the disclosure are set forth in the accompanying drawings and the description below. Other aspects, features, and advantages will be apparent from the description and drawings, and from the claims.

Referring to FIGS. 1-6, an example of an article of footwear 10 including a system providing for variable tension is disclosed. In some implementations, the article of footwear 10 includes an upper 100 and a sole structure 200 attached to the upper 100. The article of footwear 10 further includes a cable lock 300 and tensioning system 400 integrated into at least one of the upper 100 and the sole structure 200. The tensioning system 400 includes a cable 402 that cooperates with the cable lock 300 to move the article of footwear 10 between a constricted state and a relaxed state, as detailed below. Particularly, the cable 402 is movable in a tightening direction $D_T$ to move the article of footwear 10 into the constricted state. In some implementations, the upper 100 and the sole structure 200 cooperate to provide passages and guides for routing portions of the cable 402 to and from the cable lock 300. The cable lock 300 is configured to selectively secure the cable 402 in the tightened or constricted state.

The footwear 10 may further include an anterior end 12 associated with a forward-most point of the footwear 10, and a posterior end 14 corresponding to a rearward-most point of the footwear 10. As shown in FIG. 1, a longitudinal axis $A_{10}$ of the footwear 10 extends along a length of the footwear 10 from the anterior end 12 to the posterior end 14, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14.

The article of footwear 10 may be divided into one or more regions along the longitudinal axis $A_{10}$. The regions may include a forefoot region 20, a mid-foot region 22 and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone.

The upper 100 includes a plurality of components that cooperate to define an interior void 102 and an ankle opening 104, which cooperate to receive and secure a foot for support on the sole structure 200. For example, the upper 100 includes a pair of side panels or quarter panels 106 in the mid-foot region 22 on opposite sides of the interior void 102. A throat 108 extends across the top of the upper 100, and defines an instep region extending between the quarter panels 106 from the ankle opening 104 to the forefoot region 20. In the illustrated example, an upper portion of the throat 108 is open, whereby opposing upper edges 110 of the quarter panels 106 are separated from each other by a space 112 and can be selectively spaced apart from each other to adjust the size of the interior void 102 and the ankle opening 104. In some examples, a tongue 114 may be disposed within the space 112 of the throat 108 to cover the interior void 102. The upper 100 further includes a plurality of conduits or cable guides 426 spaced along each of the upper edges 110. As discussed in greater detail below, in some examples a portion of cable 402 may be alternatingly routed between the cable guides 426 of the respective quarter panels 106 along the length of the throat 108.

The upper 100 may be further described as including heel side panels 116 extending through the heel region 24 along the lateral and medial sides 16, 18 of the ankle opening 104. A heel counter 118 wraps around the posterior end 14 of the footwear 10 and connects the heel side panels 116. In the illustrated example, the heel counter 118 includes a pair of support arms 119 extending along the sole structure 200 on the lateral side 16 and the medial side 18. Here, each of the support arms 119 extends to a terminal end in the mid-foot region 22. As discussed in greater detail below, the support arms 119 may provide reinforcement to the heel counter 118 to minimize deflection when a tightening force $F_T$ is applied to the cable 402 at the posterior end 14. Uppermost edges of the tongue 114, the heel side panels 116, and the heel counter 118 cooperate to form a collar 120, which defines the ankle opening 104 of the interior void 102. The upper 100 may include one or more grip features 122 attached to the collar 120 adjacent the ankle opening 104 for pulling the footwear 10 onto and off of the foot.

As illustrated best in FIG. 1, the upper 100 may be provided with one or more shrouds 124 for concealing the various components of the tensioning system 400. For example, at least a portion of the cable 402 of the tensioning system 400 may be routed beneath the shroud 124. In the illustrated example, a portion of the cable 402 extending from the cable lock 300 on the throat 108 to the posterior end 14 may be concealed within the shroud 124 on each of the lateral side 16 and the medial side 18.

The upper 100 may be formed from one or more materials that are stitched or adhesively bonded together to define the interior void 102. Suitable materials of the upper 100 may include, but are not limited to, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the upper 100 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

In the illustrated example, the heel counter 118 may be formed of a different material than the heel side panels 116 and/or the remainder of the upper 100. In some examples, the heel counter 118 is formed of a material having a higher modulus of elasticity (i.e., greater stiffness) than the material of the heel side panels 116, whereby the upper 100 can be stretched to increase the size of the interior void 102 while the heel counter 118 is configured to provide increased rigidity. In other examples, the heel counter 118 and the heel side panels 116 are formed of the same material, and may be formed of a single piece of material. Optionally, the heel counter 118 may include a laminate construction including a base layer 118*a* and an outer shell layer 118*b* including a different material than the base layer 118*a*.

With reference to FIGS. 3, 6, 7A and 7B, the sole structure 200 includes a midsole 202 and an outsole 204. Generally, the midsole 202 is configured to impart performance characteristics to the sole structure 200, such as cushioning, responsiveness, and energy distribution. The outsole 204 may be attached to or formed integrally with the midsole 202, and forms a ground-engaging surface 26 of the article of footwear 10. Accordingly, the outsole 204 is configured to impart characteristics related to traction and abrasion resistance.

The midsole 202 is formed as a composite structure, and includes a bladder 206 and one or more optional foam inserts 208, 208*a*. As described in greater detail below, the bladder 206 and the foam inserts 208, 208*a* cooperate to form a substantially flush and continuous top surface 210 of the midsole 202, which defines a profile of a footbed. The midsole 202 further includes a bottom surface 212 formed on an opposite side of the midsole 202 than the top surface 210. The bottom surface 212 defines a profile of the ground-engaging surface 26 of the sole structure 200. A peripheral side surface 214 of the midsole 202 extends between the top surface 210 and the bottom surface 212, and defines an outer peripheral profile of the sole structure 200.

Figure 7A:
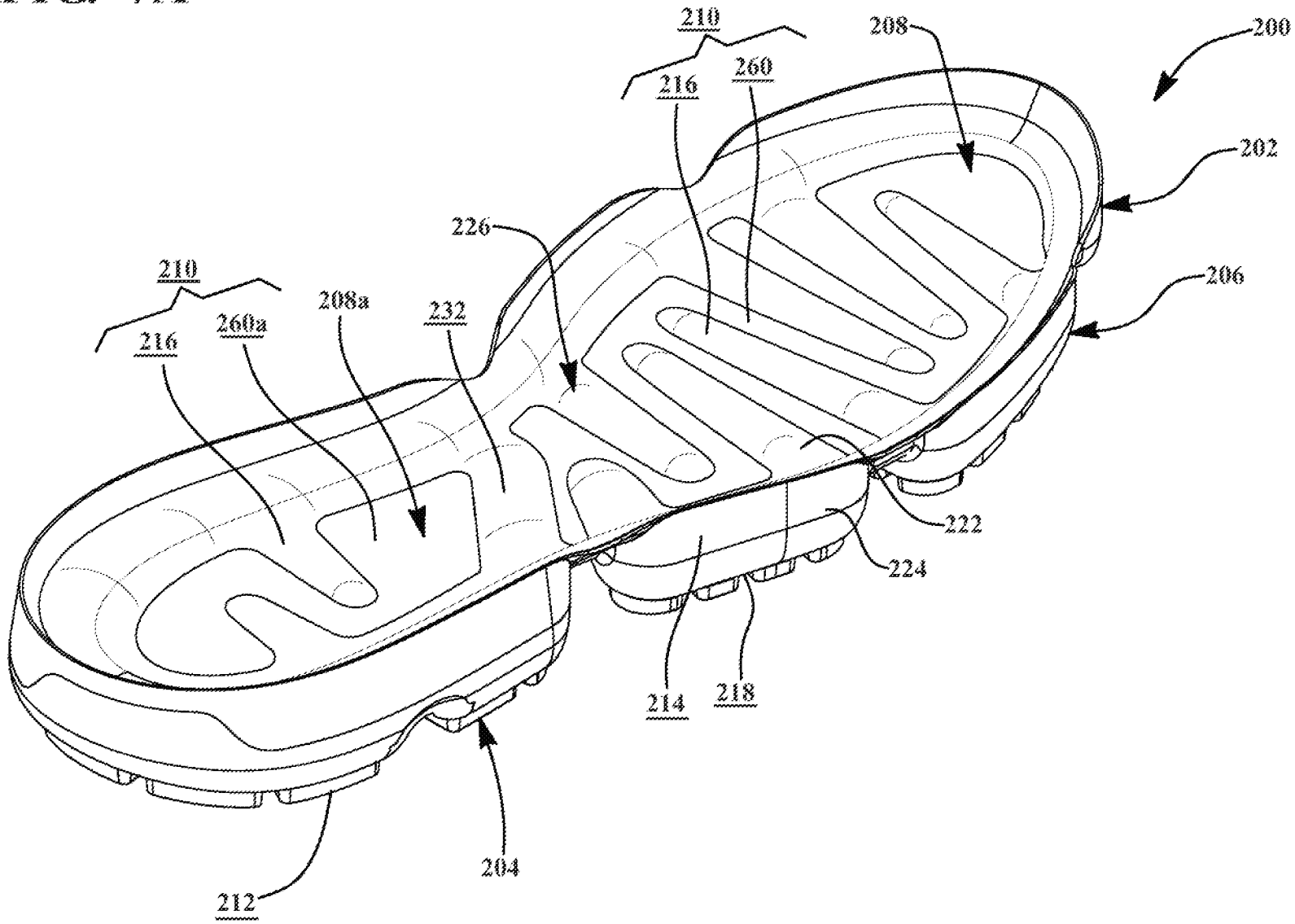
FIG. 7A is a top perspective view of a sole structure of the article of footwear of FIG. 1.

With reference to FIG. 7A, the bladder 206 is configured to extend from the anterior end 12 to the posterior end 14 of the footwear 10. The bladder 206 may be described as including an upper surface 216 and a lower surface 218 formed on an opposite side of the bladder 206 from the upper surface 216. As described in greater detail below, and best shown in FIG. 7B, the upper surface 216 of the bladder 206 may include one or more recesses 220, 220*a* formed therein. In the illustrated example, the upper surface 216 includes a forefoot recess 220 extending through the forefoot region 20 and the mid-foot region 22, and a heel recess 220*a* formed in the heel region 24. As described in greater detail below, and illustrated in FIGS. 7A and 7B, when the midsole 202 is assembled, the foam inserts 208, 208*a* are received within the respective recesses 220, 220*a* such that the upper surface 216 of the bladder 206 is exposed and cooperates with top surfaces of the inserts 208, 208*a* to provide a continuous and substantially flush top surface 210 of the midsole 202.

Figure 7B:
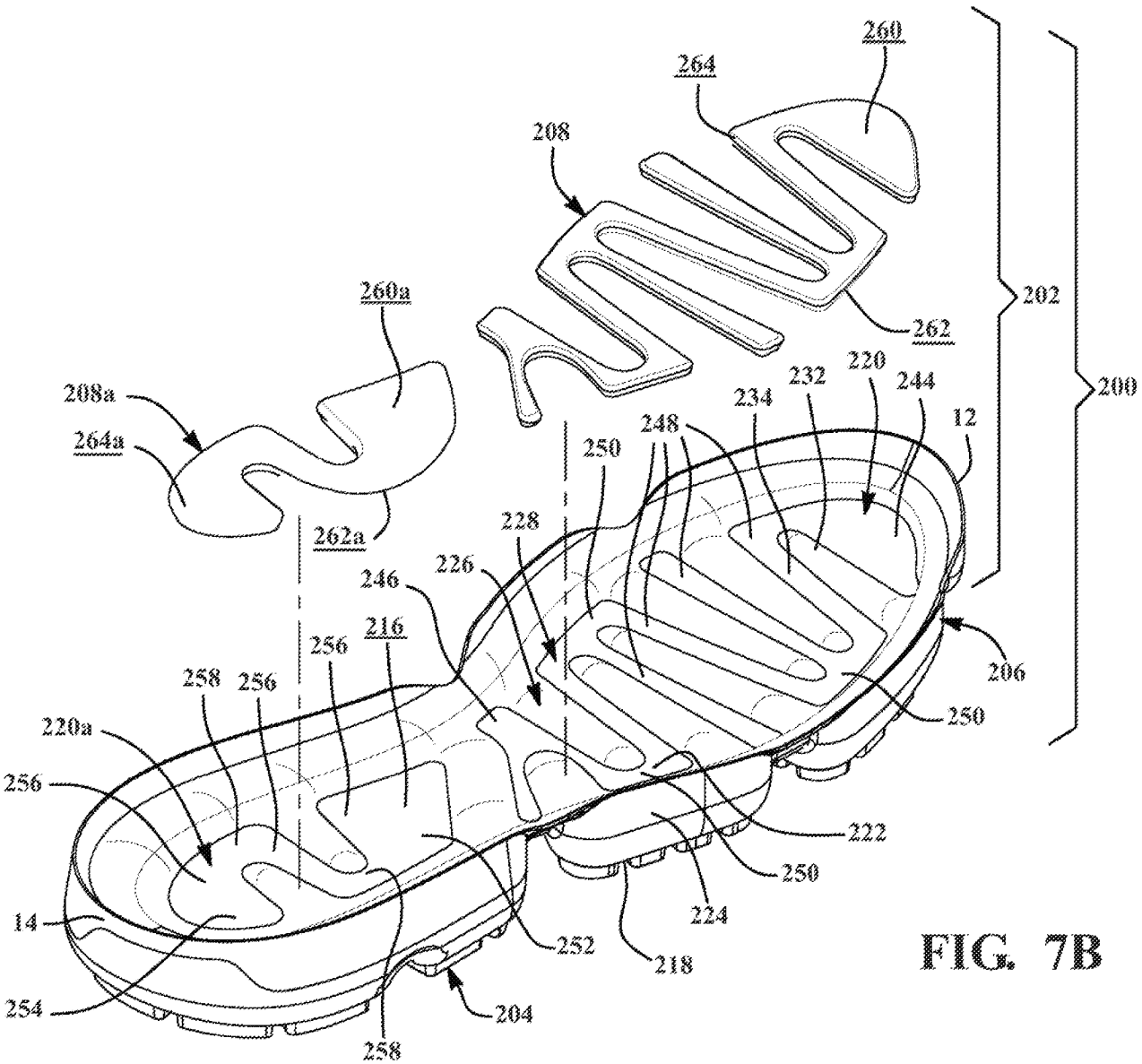
FIG. 7B is an exploded view of the sole structure of FIG. 7A.

With continued reference to FIG. 7B, the bladder 206 is constructed of an upper barrier layer 222 and a lower barrier layer 224, which are joined together with each other at discrete locations to form a chamber 226 and a web area 228. The chamber 226 is associated with an area of the bladder 206 where interior surfaces of the upper and lower barrier layers 222, 224 are not joined together and, thus, are separated from one another to define an interior void 230 of the bladder 206. Conversely, the web area 228 is associated with areas of the bladder 206 where the upper barrier layer 222 is joined to the lower barrier layer 224. With reference to FIG. 7B, the chamber 226 and the web area 228 cooperate to define the recesses 220, 220*a* in the upper surface 216 of the bladder 206, whereby the web area 228 defines a bottom portion of the recesses 220, 220*a* and the chamber 226 defines an outer periphery of the recesses 220, 220*a*.

As used herein, the term "barrier layer" (e.g., barrier layers 222, 224) encompasses both monolayer and multilayer films. In some embodiments, one or both of barrier layers 222, 224 are each produced (e.g., thermoformed or blow molded) from a monolayer film (a single layer). In other embodiments, one or both of the barrier layers 222, 224 are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 222, 224 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 222, 224 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 222, 224 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 222, 224 include two or more sublayers, examples of suitable multilayer films include microlayer films, such as those disclosed in Bonk et al., U.S. Pat. No. 6,582,786, which is incorporated by reference in its entirety. In further embodiments, the barrier layers 222, 224 may each independently include alternating sublayers of one or more TPU copolymer materials and one or more EVOH copolymer materials, where the total number of sublayers in each of the barrier layers 222, 224 includes at least four (4) sublayers, at least ten (10) sublayers, at least twenty (20) sublayers, at least forty (40) sublayers, and/or at least sixty (60) sublayers.

The chamber 226 can be produced from the barrier layers 222, 224 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 222, 224 can be produced by co-extrusion followed by vacuum thermoforming to produce an inflatable chamber 226, which can optionally include one or more valves (e.g., one way valves) that allows the chamber 226 to be filled with the fluid (e.g., gas).

The chamber 226 can be provided in a fluid-filled (e.g., as provided in footwear 10) or in an unfilled state. The chamber 226 can be filled to include any suitable fluid, such as a gas or liquid. In an aspect, the gas can include air, nitrogen ($N_2$), or any other suitable gas. In other aspects, the chamber 226 can alternatively include other media, such as pellets, beads, ground recycled material, and the like (e.g., foamed beads and/or rubber beads). The fluid provided to the chamber 226 can result in the chamber 226 being pressurized. Alternatively, the fluid provided to the chamber 226 can be at atmospheric pressure such that the chamber 226 is not pressurized but, rather, simply contains a volume of fluid at atmospheric pressure.

The chamber 226 desirably has a low gas transmission rate to preserve its retained gas pressure. In some embodiments, the chamber 226 has a gas transmission rate for nitrogen gas that is at least about ten (10) times lower than a nitrogen gas transmission rate for a butyl rubber layer of substantially the same dimensions. In an aspect, the chamber 226 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 222, 224). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some examples, the formation of the recesses 220, 220*a* in the upper surface 216 is induced by filling the interior void 230 of the chamber 226 with a pressurized fluid, causing the upper barrier layer 222 to bulge in areas that are not joined to the lower barrier layer 224 (i.e., the chamber 226). For example, the upper barrier layer 222 of the bladder 206 may be substantially planar, or have a continuous contour when the chamber 226 is in an unfilled or relaxed state. However, when the interior void 230 of the chamber 226 is filled, the upper barrier layer 222 and the lower barrier layer 224 will be biased apart from each other. Even where the upper barrier layer 222 has a naturally flat or continuous profile in the relaxed state, the filling of the interior void 230 will cause the upper barrier layer 222 to bulge in areas that are not joined to the lower barrier layer 224 (i.e., the web area 228), thereby forming the one or more recesses 220, 220*a* in between adjacent segments of the chamber 226. In some examples, the upper barrier layer 222 may be molded or pre-formed to include one or more of the recesses 220, 220*a* in areas that are not joined to the lower barrier layer 224.

Exterior surfaces of the upper and lower barrier layers 222, 224 define the respective upper and lower surfaces 216, 218 of the bladder 206. Accordingly, when the interior void 230 of the chamber 226 is filled with a fluid and the upper barrier layer 222 is caused to bulge, the upper surface 216 of the bladder 206 can be described as having an outer portion 232, an inner portion 234. The outer portion 232 of the upper surface 216 corresponds to a portion of the upper barrier layer 222 that is spaced farthest away from the lower barrier layer 224 along a direction perpendicular to the ground-engaging surface 26, while the inner portion 234 is associated with a portion of the upper barrier layer 222 that is disposed closest to the lower barrier layer 224. In the illustrated example, the inner portion 234 is associated with the portion of the upper barrier layer 222 that is joined to the lower barrier layer 224 (i.e., the web area 228). A peripheral portion 236 is associated with an intermediate portion of the chamber 226 that extends from the web area 228 (i.e., the inner portion 234) to the top-most portion of the chamber 226 (i.e., the outer portion 232).

Figure 6:
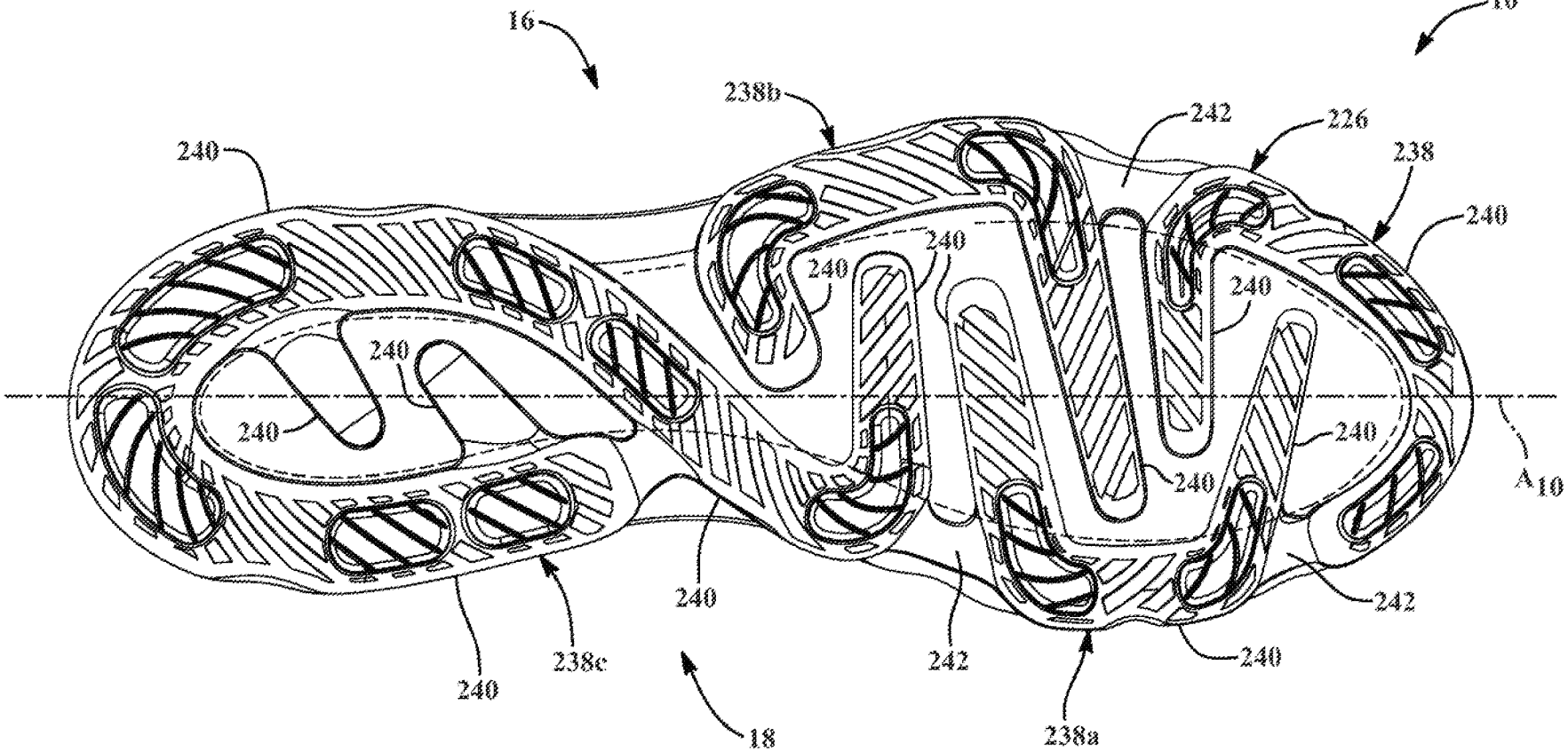
FIG. 6 is a bottom plan view of the article of footwear of FIG. 1.

With reference to FIG. 6, the chamber 226 may be described as including a plurality of sub-chambers 238-238*c* each comprising a plurality of segments 240 that are at least partially spaced apart from each other by the web area 228 and cooperate to define a profile of the ground-engaging surface 26 of the footwear 10. The segments 240 of each sub-chamber 238-238*c* are in direct fluid communication with each other. Further, a series of the segments 240 are arranged sequentially with each other, as best shown in FIG. 6. The chamber 226 may further include one or more conduits 242 that provide fluid communication between pairs of the sub-chambers 238-238*c*. In some examples, all of the sub-chambers 238-238*c* may be in fluid communication with one or more conduits 242 to form a substantially continuous chamber 226 along the length of the sole structure 200. Accordingly, the chamber 226 may comprise a continuous network of fluidly connected sub-chambers 238-238*c*, whereby a change in pressure in a first one of the sub-chambers 238-238*c* is transmitted to a second one of the sub-chambers 238-238*c*. In other examples, one or more of the sub-chambers 238-238*c* may be fluidly isolated, where each sub-chamber 238-238*c* includes a plurality of interconnected segments 240 that are isolated from the interconnected segments 240 forming the other sub-chambers 238-238*c*.

Each of the segments 240 and the conduits 242 may be filled with a pressurized fluid (i.e., gas, liquid) to provide cushioning and stability for the foot during use of the footwear 10. In some implementations, compressibility of a first portion of the plurality of segments 240 of the sub-chambers 238-238*c* under an applied load provides a responsive-type cushioning, while a second portion of the segments 240 of the sub-chambers 238-238*c* may be configured to provide a soft-type cushioning under an applied load. Accordingly, the sub-chambers 238-238*c* may cooperate to provide gradient cushioning to the article of footwear 10 that changes as the applied load changes (i.e., the greater the load, the more the segments 240 are compressed and, thus, the more responsive the footwear 10 performs).

In other implementations, one or more cushioning materials (none shown), such as polymer foam and/or particulate matter, are enclosed by one or more of the segments 240 in place of, or in addition to, the pressurized fluid to provide cushioning for the foot. In these implementations, the cushioning materials may provide one or more of the segments 240 with cushioning properties different from the segments 240 filled with the pressurized fluid. For example, the cushioning materials may be more or less responsive or provide greater impact absorption than the pressurized fluid.

As discussed above, the recesses 220, 220*a* may be formed between bulges in the upper surface 216, which are created when the interior void 230 of the chamber 226 is filled and the upper barrier layer 222 is biased apart from the lower barrier layer 224. Accordingly, the profiles of the recesses 220, 220*a* formed in the upper surface 216 correspond to the arrangement of the sub-chambers 238-238*c*, segments 240, and/or conduits 242. In the example of the bladder 206 shown in FIG. 7B, the chamber 226 forms a forefoot recess 220 in the forefoot region 20, and a heel recess 220*a* in the heel region 24.

With continued reference to FIG. 7B, the forefoot recess 220 extends continuously from a first end 244 at the anterior end 12 to a second end 246 in the mid-foot region 22 of the sole structure 200. Here, the forefoot recess 220 may be described as including a plurality of interconnected segments 248, 250 arranged in a substantially continuous and serpentine manner from the anterior end 12 to the mid-foot region 22. In other words, the forefoot recess 220 includes a first plurality of laterally extending segments 248 each extending continuously across the width of the bladder 206 from the lateral side 16 to the medial side 18, and a first plurality of longitudinally extending segments 250 extending between and connecting adjacent ones of the laterally extending segments 248 along the lateral side 16 and the medial side 18.

Referring still to FIG. 7B, the heel recess 220*a* extends continuously from a first end 252 in the mid-foot region 22 to a second end 254 at the posterior end 14. As with the forefoot recess 220, the heel recess 220*a* includes a plurality of laterally extending segments 256 extending across the width of the bladder 206 from the lateral side 16 to the medial side 18. The heel recess 220*a* also includes longitudinally extending segments 258 extending along the lateral side 16 and/or the medial side 18, and connecting ends of adjacent ones of the laterally extending segments 256.

With continued reference to FIGS. 7A and 7B, the illustrated example of the sole structure 200 optionally includes a first foam insert 208 associated with the forefoot recess 220 of the sole structure 200, and a second foam insert 208*a* associated with the heel recess 220*a* of the sole structure 200. Each of the inserts 208, 208*a* includes a top surface 260, 260*a* and a bottom surface 262, 262*a* formed on an opposite side of the foam insert 208, 208*a* from the top surface 260, 260*a*. A peripheral side surface 264, 264*a* of each of the inserts 208, 208*a* extends from the top surface 260, 260*a* to the bottom surface 262, 262*a*.

Generally, each of the foam inserts 208, 208*a* is configured to be received within the respective recesses 220, 220*a*. As described above, the foam inserts 208, 208*a* may cooperate with the outer portion 232 of the upper surface 216 of the bladder 206 to form the top surface 210 of the midsole 202, which may be contoured to accommodate a profile of a plantar surface of a foot. Accordingly, the foam inserts 208, 208*a* may be formed such that the top surfaces 260, 260*a* merge with the outer portion 232 of the upper surface 216 of the bladder 206 in a substantially tangential relationship, thereby forming a continuous and substantially flush top surface 210 of the midsole 202. As shown in FIG. 7A, when the foam inserts 208, 208*a* are assembled within the recesses 220, 220*a*, the outer portion 232 of the upper surface 216 of the bladder 206 will be exposed between the segments of the foam inserts 208, 208*a* corresponding to the segments 256, 258 of the recesses 220, 220*a*.

The foam inserts 208, 208*a* are configured to fill the recesses 220, 220*a* to form a substantially continuous and flush top surface 210 of the midsole 202. Accordingly, the bottom surfaces 262, 262*a* of the foam inserts 208, 208*a* are configured to oppose or interface with the inner portion 234 of the upper surface 216, while the peripheral side surfaces 264, 264*a* are configured to cooperate with the peripheral portion 236 of the upper surface 216. Accordingly, where the web area 228 is substantially planar, as shown, the bottom surfaces 262, 262*a* of the foam inserts 208, 208*a* will also be substantially planar. Likewise, where the peripheral portion 236 of the upper surface 216 of the bladder 206 has a convex profile, the peripheral side surfaces 264, 264*a* of the inserts 208, 208*a* will have a concave profile configured to receive the peripheral portion 236 of the upper surface 216. As such, the inserts 208, 208*a* are shaped to be matingly received by the respective recesses 220, 220*a* such that the inserts 208, 208*a* substantially fill the respective recesses 220, 220*a*.

As described above, the foam inserts 208, 208*a* are formed of a resilient polymeric material, such as foam or rubber, to impart properties of cushioning, responsiveness, and energy distribution to the foot of the wearer. In one example, the first foam insert 208 and the second foam insert 208*a* are formed of the same material to impart similar performance characteristics to each of the forefoot region 20, the mid-foot region 22, and the heel region 24. In other examples, the first foam insert 208 and the second foam insert 208*a* may be formed of different materials to impart different characteristics to at least one of the forefoot region 20, the mid-foot region 22, and the heel region 24.

Example resilient polymeric materials for the inserts 208, 208*a* may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for the barrier layers 222, 224. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Referring to FIGS. 1 and 8-12, an example of the cable lock 300 according to the instant disclosure are provided. As shown in FIG. 1, the cable lock 300 is disposed on the instep region of the upper 100, adjacent to the ankle opening 104. Accordingly, the cable lock 300 may be disposed on or over the throat 108 and/or the tongue 114. As described in greater detail below, the cable lock 300 is generally configured to interface with the cable 402 of the tensioning system 400 to selectively secure a position of the cable 402 relative to the upper 100.

Figure 8:
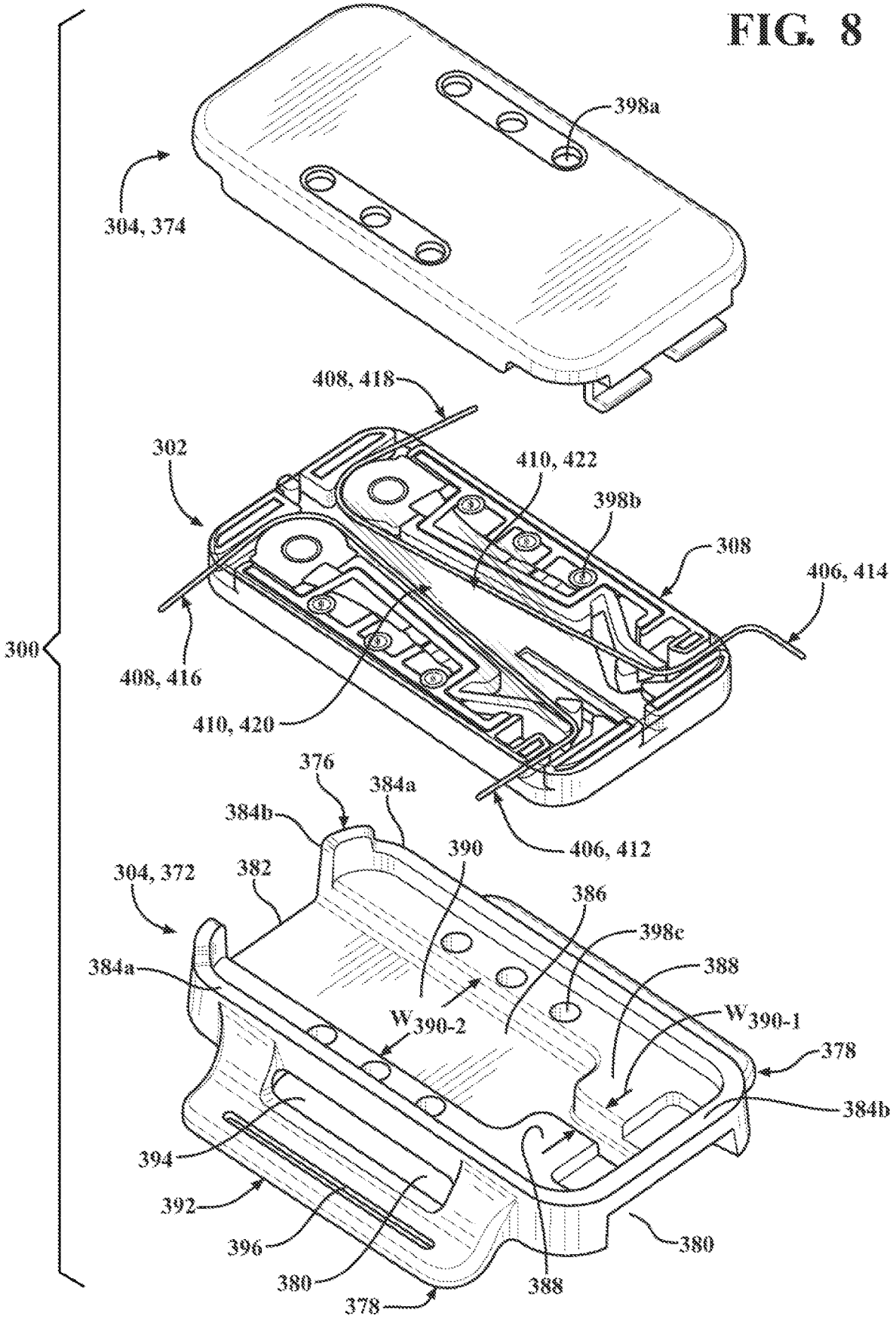
FIG. 8 is an exploded view of a cable lock in accordance with principles of the disclosure.

Referring to FIG. 8, the cable lock 300 includes a lock device 302 that is removably received within a cartridge 304. As described in greater detail below, the lock device 302 is operable between a locked state and an unlocked state, wherein the cable 402 is permitted to move in a loosening direction $D_L$ through the lock device 302 when the lock device 302 is in the unlocked state and is prevented from moving in the loosening direction $D_L$ when the lock device 302 is in the locked state. The cartridge 304 removably receives the lock device 302, and is configured for attachment to an exterior of the upper 100. In the illustrated example, the cartridge 304 is attached over the throat 108 of the upper. As discussed below, the cartridge 304 may include provisions for spacing the lock device 302 apart from the exterior surface of the upper 100, such that the cable 402 can be routed beneath the lock device 302 and between the cartridge 304 and the upper 100.

Figure 9:
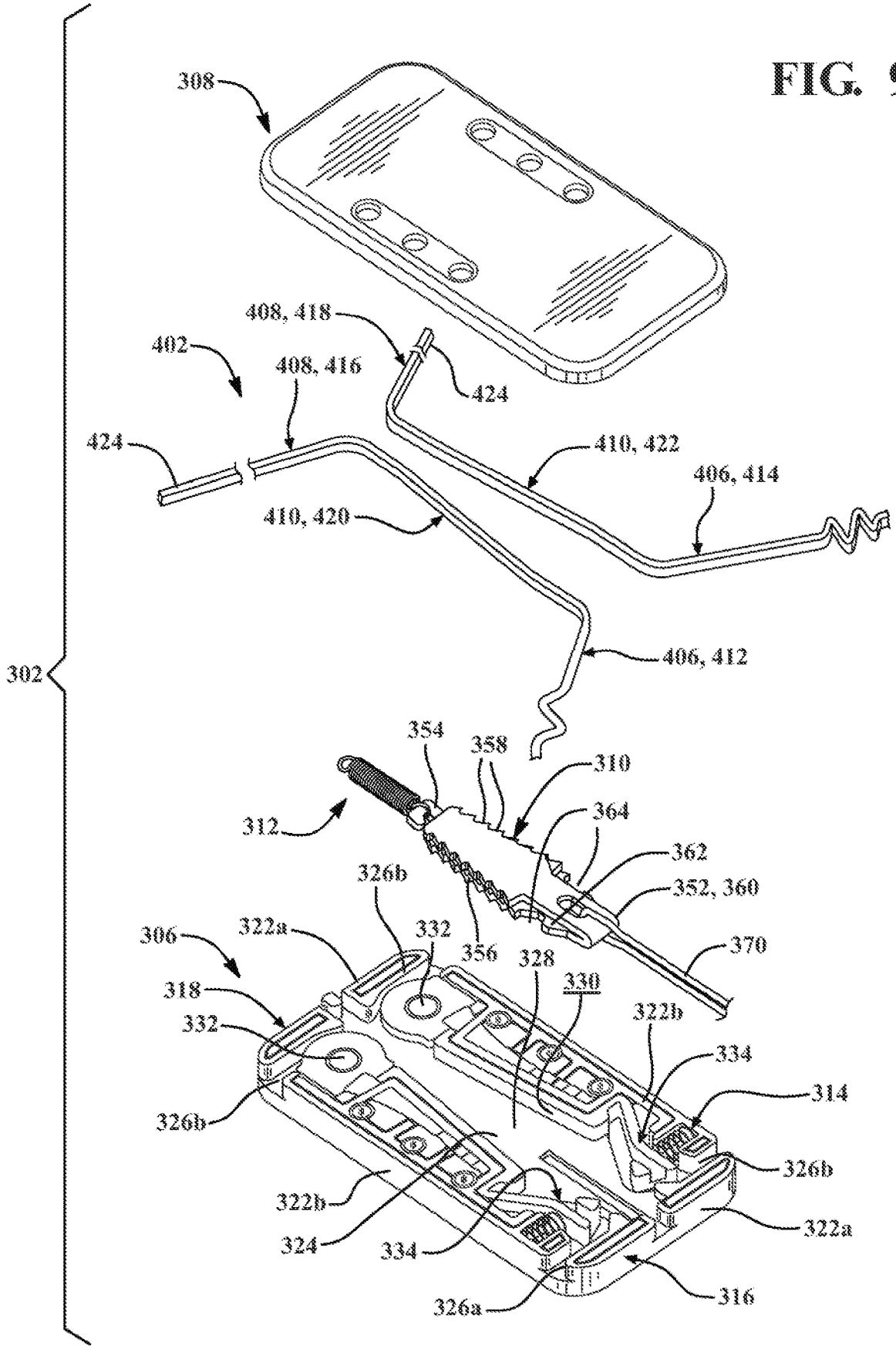
FIG. 9 is an exploded view of a lock device of the cable lock of FIG. 8.

As shown in FIG. 9, the lock device 302 has a housing 306 and a cover 308. A locking member 310 is disposed within the lock device 302, and is configured to selectively engage the cable 402. The lock device 302 further includes a first biasing member 312 configured to bias the locking member 310 towards an engaged or locked state, and a pair of second biasing members 314 configured to cooperate with the housing 306 to retain the locking member 310 in a disengaged or unlocked state, as described below with respect to FIGS. 10 and 11.

Figure 12:
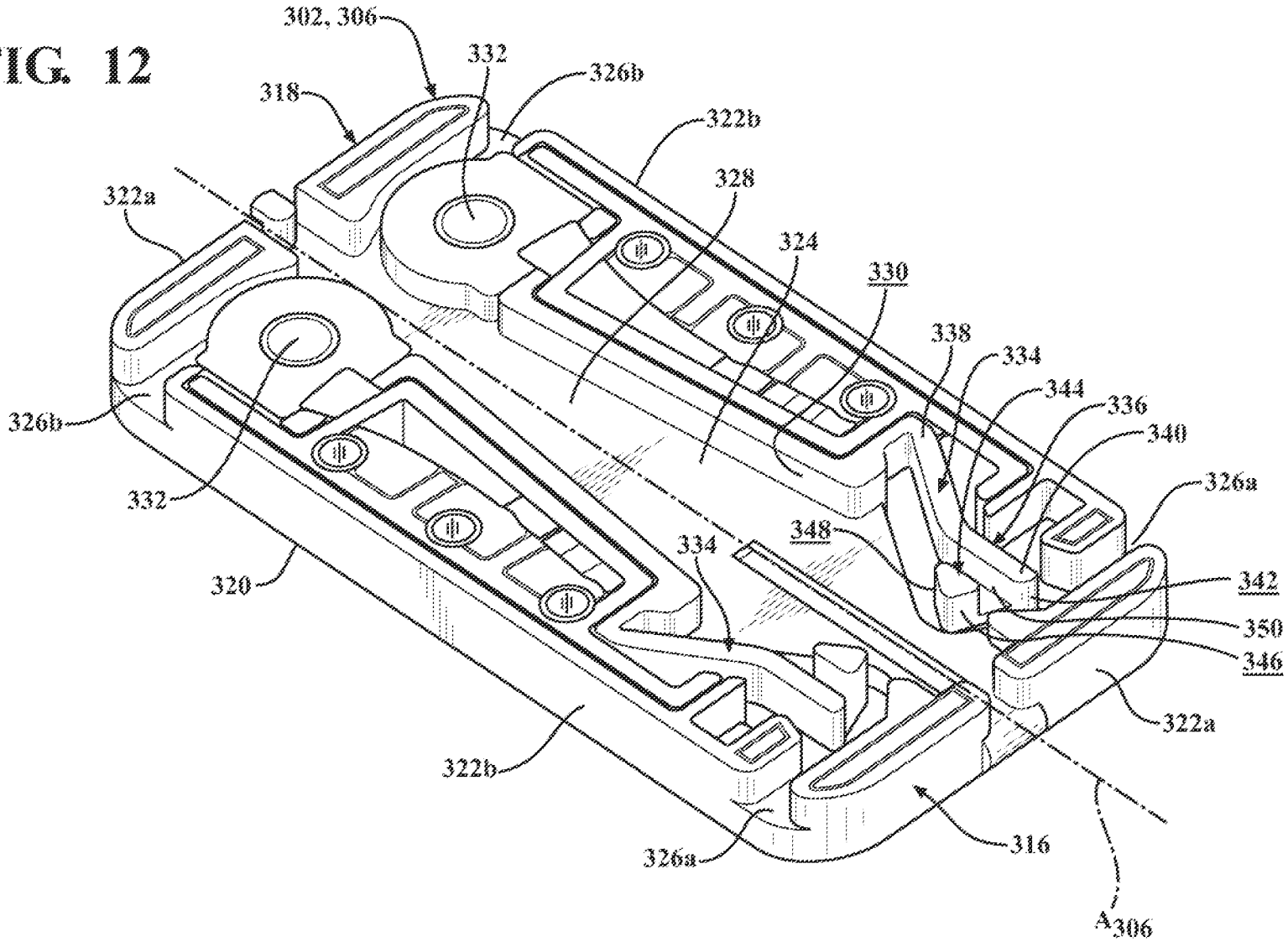
FIG. 12 is a perspective view of a housing of the lock device of FIG. 9.

With reference to FIG. 12, an example of a housing 306 is provided. The housing 306 defines a length extending between a first end 316 and a second end 318. The housing 306 includes a base portion 320 and peripheral walls 322*a*, 322*b* extending from the base portion 320 to define a main cavity 324 of the lock device 302. The main cavity 324 is configured to receive the cable 402 and the locking member 310. In the illustrated example, the peripheral walls 322*a*, 322*b* include a pair of end walls 322*a* at each of the first end 316 and the second end 318, and an opposing pair of sidewalls 322*b* extending between the end walls 322*a*. In other examples, the housing 306 may include different configurations of peripheral walls, and define an annular peripheral wall of a circular lock device 302, or may be multi-faceted and define a polygonal lock device 302.

The peripheral walls 322*a*, 322*b* may include a plurality of cable openings 326*a*, 326*b* formed therethrough for providing communication between the main cavity 324 and an exterior of the lock device 302. In the illustrated example, the openings 326*a*, 326*b* include a first pair of openings 326*a* proximate to the first end 316 for receiving a first end of the cable 402, and a second pair of openings 326*b* proximate to the second end 318 for receiving a second end of the cable 402. In the example of the housing 306 shown in FIG. 12, the openings 326*a*, 326*b* are formed in the sidewalls 322*b* of the housing. However, the openings 326*a*, 326*b* may be formed through corners of the housing 306. In other examples the openings 326*a*, 326*b* may be formed entirely in the end walls 322*a* of the housing.

With continued reference to FIG. 12, the housing 306 includes a locking channel 328 defined by an opposing pair of engagement surfaces 330 that converge toward one another such that the locking channel 328 is associated with a wedge-shaped configuration tapering along a direction from the first end 316 to the second end 318 of the housing 306. Accordingly, the engagement surfaces 330 are defined by corresponding sidewalls of the housing 306 converging toward one another and extending between the base portion 320 and the cover 308 to define the locking channel 328. As described in greater detail below, the engagement surfaces 330 cooperate with the locking member 310 to secure a position of the cable 402.

Figure 10:
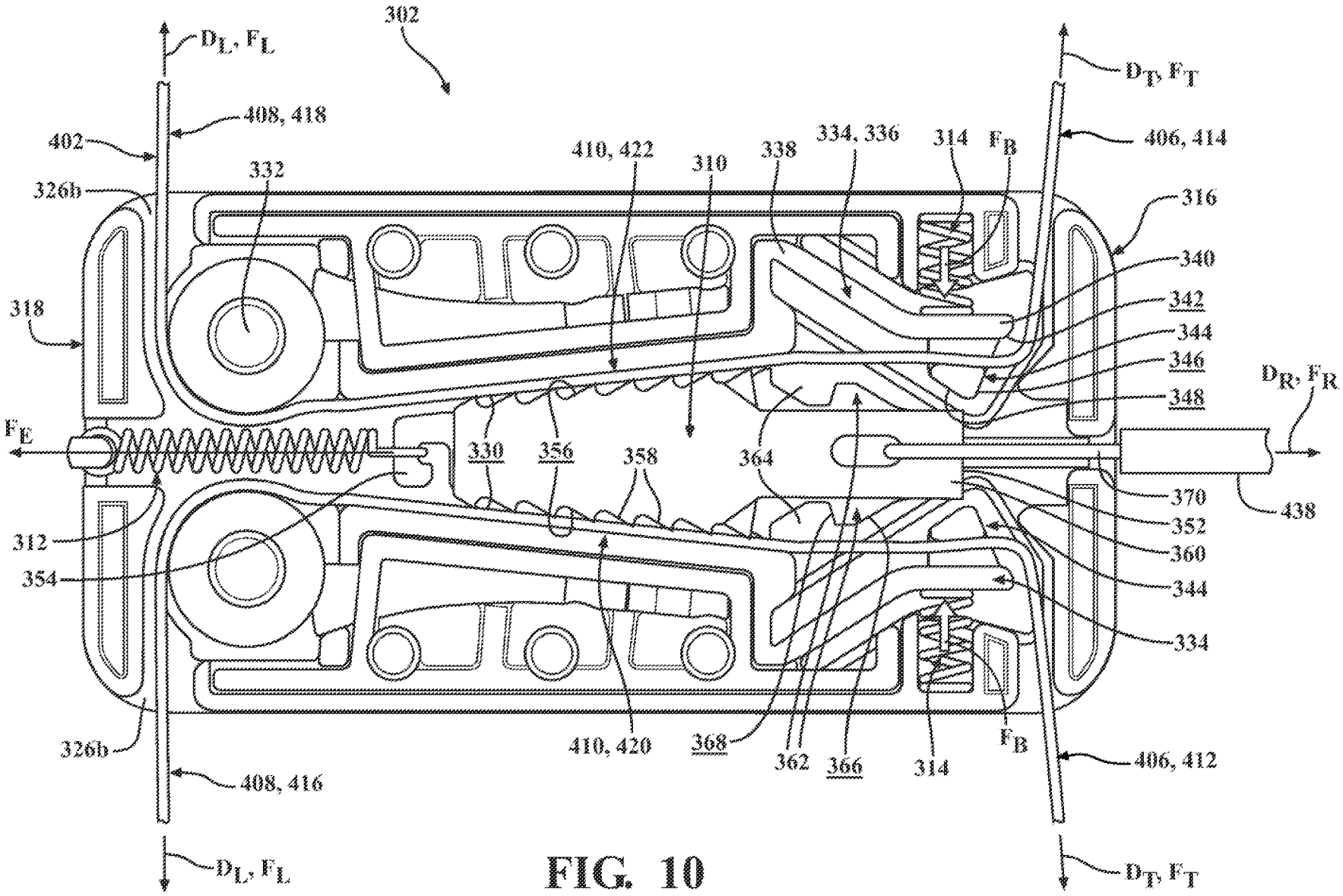
FIG. 10 is a top plan view of the lock device of FIG. 9, showing the lock device in a locked state.
Figure 11:
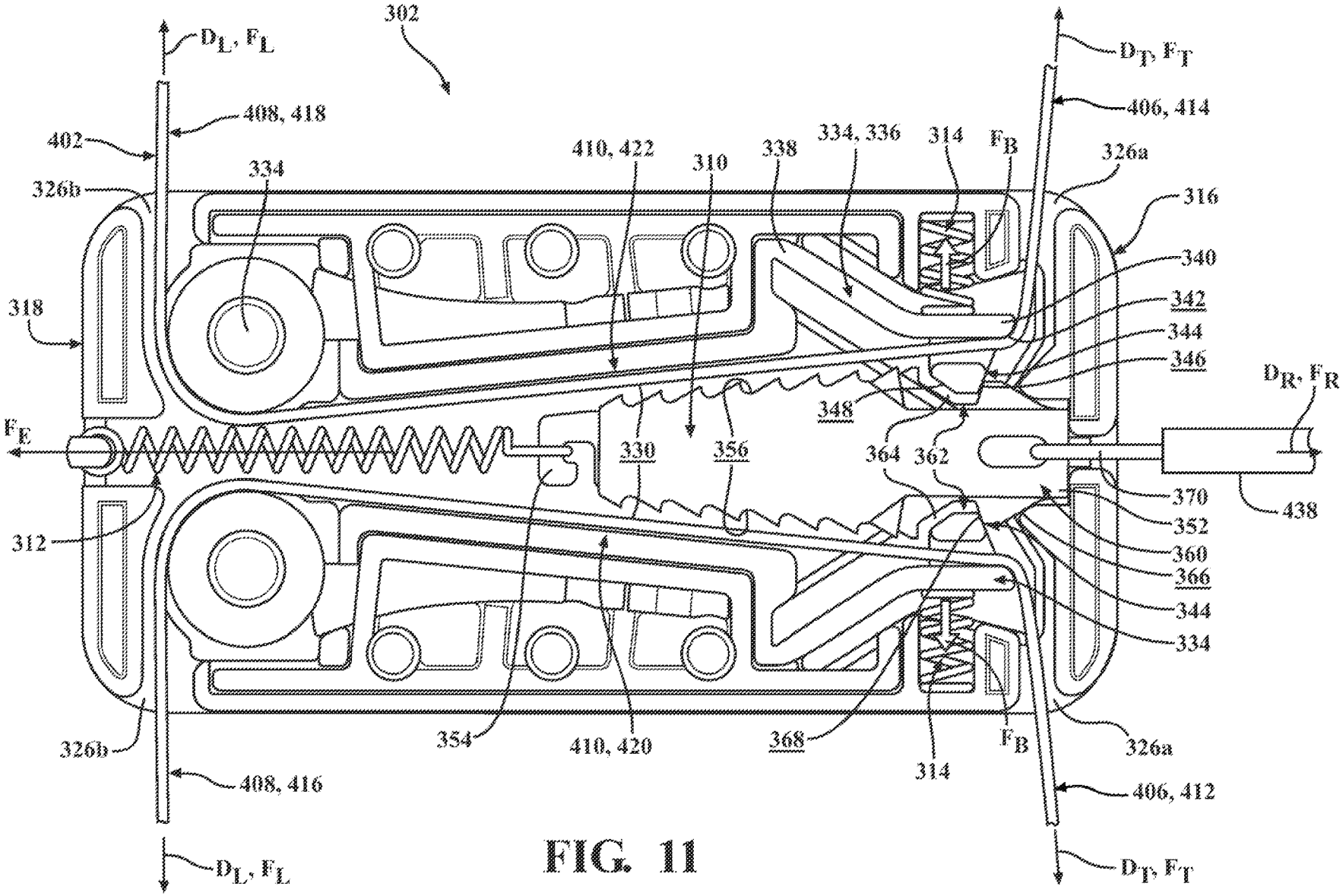
FIG. 11 is a top plan view of the lock device of FIG. 9, showing the lock device in an unlocked state.

With reference to FIG. 12, in some examples the housing 306 may further include one or more guide shafts 332. In the illustrated examples, the housing 306 includes a pair of the shafts 332 respectively disposed between the locking channel 328 and each of the second openings 326*b* at the second end 318. Accordingly, the shafts 332 are positioned within the housing 306 such that the shafts 332 will be engaged by the cable 402 as the cable 402 passes between the locking channel 328 and the second openings 326*b*, as shown in FIGS. 10 and 11. However, the shafts 332 may be positioned in other areas of the housing 306, such that the shafts 332 are arranged along a path of the cable 402. Optionally, the guide shafts 332 may support rotatable guide wheels (not shown) for guiding the cable 402 through the housing 306. In some examples, the guide wheels may include a series of detents operable to interface with a flexible tab of the housing, whereby the detents engage the tab as the wheel is rotated to provide tactile and/or audible feedback as the cable 402 is pulled through the housing 306.

With continued reference to FIGS. 10-12, the housing 306 includes a pair of retention features 334 configured to selectively engage the locking member 310 to secure the locking member 310 in the unlocked state, as shown in FIG. 11. The retention features 334 associated with the housing 306 may include a first retention feature 334 and a second retention feature 334 disposed on opposite sides of the housing 306, whereby the retention features 334 are biased inward toward the locking member 310 by the second biasing members 314. In the illustrated example, the retention features 334 each include a flexible tab 336 integrally formed with the housing 306 such that the retention features 334 act as living hinges movable between an engaged state and a disengaged state for allowing the locking member 310 to pass therebetween. Accordingly, each tab 336 extends from a fixed first end 338 to a detached distal end 340. As shown, the distal ends 340 of each tab 336 may partially define a path of the cable 402 between the locking channel 328 and the first openings 326*a* at the first end 316 of the housing 306. Accordingly, the distal end 340 may include an inner guide surface 342 along which the cable 402 passes between the locking channel 328 and a respective one of the first openings 326*a*.

Each of the retention features 334 further includes a projection 344 extending laterally into the locking channel 328 from the distal end 340 of the tab 336. A width of the projection 344 may taper along a direction from the first end 316 to the second end 318, such that the projection 344 includes a retention surface 346 facing the first end 316 of the housing 306 and a biasing surface 348 formed on the opposite side of the projection 344 from the retention surface 346. Each of the retention surface 346 and the biasing surface 348 may be formed at an oblique angle with respect to a longitudinal axis $A_{306}$ of the housing 306. However, an angle of the retention surface 346 with respect to the longitudinal axis $A_{306}$ may be greater than the angle of the biasing surface 348, such that the retention surface 346 is configured to prove greater resistance to movement of the locking member 310 towards the second end 318 (i.e. the locked state) than towards the first end 316 (i.e. the unlocked state). In the illustrated example, the projection 344 is spaced apart from the distal end 340 of the tab 336, and cooperates with the distal end 340 to define a track 350 or passage for guiding the cable 402 from the locking channel 328 to one of the first openings 326*a*.

With continued reference to FIGS. 10 and 11, the cable lock 300 includes a pair of the second biasing members 314 configured to bias the distal ends 340 and, consequently, the projections 344 of the retention features 334 inward towards the locking channel 328. In the illustrated example, the biasing members 314 are compression springs that apply a continuous biasing force $F_B$ to the distal ends 340 of the tabs 336. In other examples, the biasing force $F_B$ may be applied by other types of biasing members 314, such as tension springs, coil springs, or by forming the first end 338 of the tab 336 as a resilient living hinge.

Referring to the examples of FIGS. 10 and 11, the locking member 310 is configured to be slidably received within the locking channel 328 of the housing 306. As provided above, the locking member 310 is operable between a locked state and an unlocked state to selectively secure a position of the cable 402. The locking member 310 includes a first end 352, a second end 354, and a pair of lock surfaces 356 formed on opposite sides of the locking member between the first end 352 and the second end 354. In some examples, the lock surfaces 356 converge toward one another along a direction from the first end 352 to the second end 354, such that the lock surfaces 356 are parallel to respective ones of the engagement surfaces 330 of the housing 306 when the locking member 310 is disposed within the locking channel 328. In the example shown, the lock surfaces 356 include projections or teeth 358 configured to permit movement by the cable 402 towards the first end 316 of the housing 306 while restricting movement by the cable 402 towards the second end 318 of the housing 306 by gripping the cable 402 when the locking member 310 is in the locked state.

The first end 352 of the locking member 310 may include a tab portion 360 having flared protuberances 362 extending outwardly therefrom, and a pair of detents 364 formed between the protuberances 362 and the lock surfaces 356. Generally, the protuberances 362 include a biasing surface 366 facing toward the first end 352 of the locking member 310 and a retention surface 368 facing in an opposite direction from the biasing surface 366. The retention surface 368 defines a portion of the detent 364. The biasing surfaces 366 of the protuberances 362 are configured to interface with the biasing surfaces 348 of the retention features 334 to spread the projections 344 apart from each other as the protuberances 362 pass between the projections 344 when the locking member 310 is moved towards the first end 316 of the housing 306. The retention surfaces 368 of the protuberances 362 are configured to interface with the retention surfaces 346 of the retention features 334 to secure the locking member 310 in the unlocked state, as shown in FIG. 11.

With continued reference to FIGS. 10 and 11, the locking member 310 includes the first biasing member 312 attached to the second end 354 and a release cord 370 attached to the first end 352. As shown, the first biasing member 312 is a tension spring having a first end attached to the second end 354 of the locking member 310 and a second end attached to the second end 318 of the housing 306. Accordingly, the first biasing member 312 is configured to apply a continuous engaging force $F_E$ to the locking member 310 to bias the locking member 310 towards the locked state. Conversely, the release cord 370 is attached to the tab 360 at the first end 352 of the locking member 310 and is configured to transmit a selectively-applied release force $F_R$ to the first end 352 of the locking member 310. As discussed below, when the release force $F_R$ is greater than the engaging force $F_E$, the locking member 310 will move from the locked state towards the unlocked state.

Referring to FIG. 8, the cartridge 304 includes a cradle 372 configured to receive the lock device 302, and a cap or lid 374 that is removably attached to the cradle 372 to secure the lock device 302 within the cradle 372. In the illustrated example, the cradle 372 includes a receptacle 376 and pair of legs 378 formed on opposite sides of the receptacle 376. Generally, the legs 378 are configured to separate the receptacle 376 from the exterior surface of the upper 100 such that a void or space 380 is formed between a bottom surface of the receptacle 376 and an outer surface of the upper 100. As shown in FIG. 1, one or more of the cables 402, 370 may be routed through the space 380 between the receptacle 376 and the upper 100.

In the illustrated example, the receptacle 376 of the cradle 372 includes a substantially planar bottom wall 382 and peripheral walls 384*a*, 384*b* extending from an outer periphery of the bottom wall 382. As shown, the bottom wall 382 and the peripheral walls 384*a*, 384*b* cooperate to define a chamber 386 configured to receive the lock device 302. Accordingly, the peripheral walls 384*a*, 384*b* may have an inner profile corresponding to an outer peripheral profile of the lock device 302. In the illustrated example, the peripheral walls 384*a*, 384*b* define a rectangular-shaped chamber 386 having a pair of sidewalls 384*a* extending along a length of the receptacle 376, and a pair of end walls 384*b* connecting the sidewalls 384*a* at opposite ends of the receptacle 376. However, in other examples, differently shaped (e.g., square, round) lock devices may be incorporated into the article of footwear, and the peripheral wall(s) may be configured to receive those lock devices.

The receptacle 376 includes a pair of shoulders 388 extending along opposite sides of the chamber 386. Here, the shoulders 388 each extend continuously along a length of the chamber 386 from a first end wall 384*b* to a second end wall 384*b* of the receptacle 376. Each of the shoulders 388 is formed adjacent to one of the sidewalls 384*a*. The shoulders 388 are configured to support the lock device 302 within the chamber 386. As shown, the shoulders 388 are spaced apart from each other along the bottom wall 382 by a channel 390 that extends continuously along the length of the receptacle 376. As such, when the cable lock 300 is assembled, the base 320 of the lock device 302 rests upon the shoulders 388 within the chamber 386, whereby the channel 390 extends beneath the lock device 302 and provides a conduit for routing the release cord 370.

The channel 390 is configured to receive the release cord 370 of the lock device 302 when the cable lock 300 is assembled. A first portion of the channel 390 may have a first width $W_{390\text{-}1}$ suitable for receiving the release cord 370, and a second portion of the channel 390 may have a second width $W_{390\text{-}2}$ suitable for receiving a release grip 438 of the fastening system 400. As shown in FIG. 1, the release grip 438 may be a strap having a greater width than the release cord 370 to provide a suitable gripping point for the release cord 370. Accordingly, the release cord 370 extends from the first end 316 of the housing 306 and is routed back beneath the housing 306 through the first portion of the channel 390 to the second portion of the channel 390 where an end of the release cord 370 may be attached to the release grip 438 within the second portion of the channel 390. As shown, the wider, the second portion of the channel 390 extends through an end wall 384*b* of the receptacle 376 so that the release grip 438 can be routed to the upper 100.

With continued reference to FIG. 8, the legs 378 of the cradle 372 extend from opposite sidewalls 384*a* of the receptacle 376 and are configured to space the bottom wall 382 of the receptacle 376 apart from the exterior surface of the upper 100. Here, a length of each of the legs 378 extends along one of the sidewalls 384*a*. In the illustrated example, each leg 378 extends outwardly from a sidewall 384*a* of the receptacle 376 to a flange 392 formed along the length of the leg 378. The legs 378 extend beyond (i.e., below) the bottom wall 382 of the receptacle 376 such that the flanges 392 formed at the ends of the legs 378 are offset from the bottom wall 382 to define the height of the space 380. In some examples, the flanges 392, and more particularly, bottom surfaces of the flanges 392, may be substantially parallel to the bottom wall 382.

Figure 2:
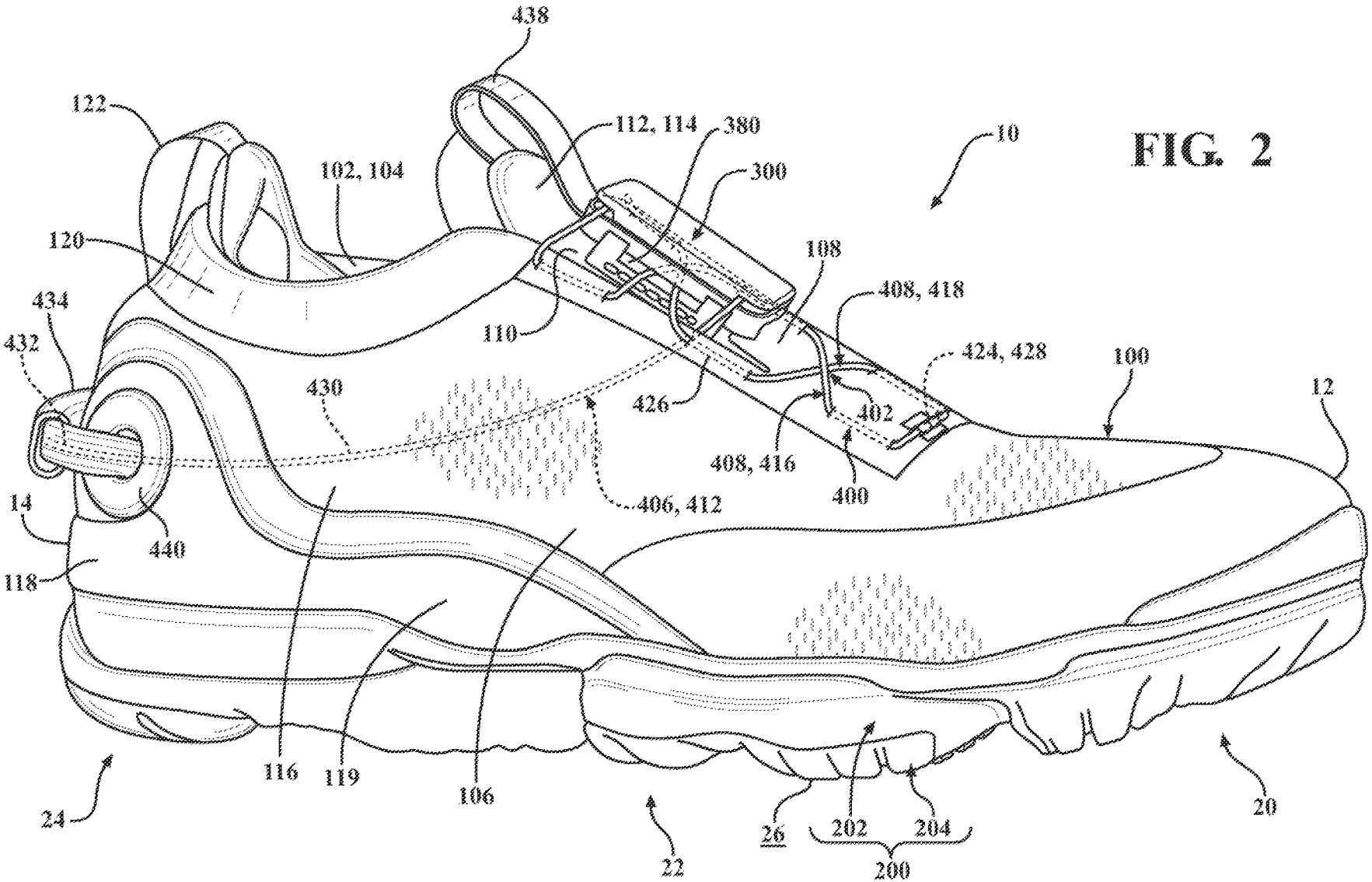
FIG. 2 is a side elevation view of the article of footwear of FIG. 1.
Figure 3:
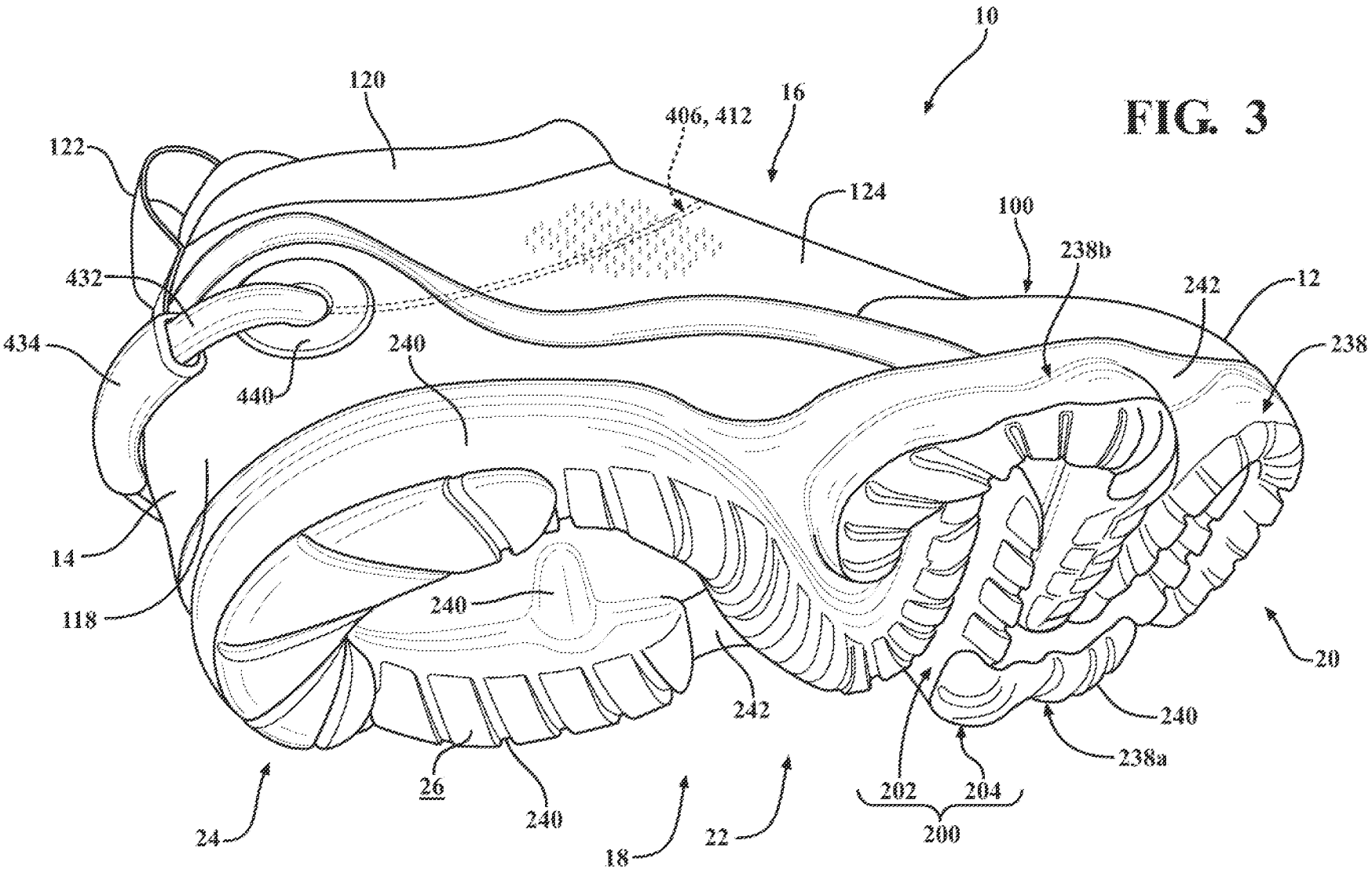
FIG. 3 is a bottom perspective view of the article of footwear of FIG. 1.

Each of the legs 378 may include one or more apertures 394 formed through the leg 378 between the flange 392 and the respective sidewall 384*a* of the receptacle 376. In the illustrated example, each leg 378 includes an elongate aperture 394 extending along a length of each leg 378. The aperture 394 provides a passageway between the flange 392 and the receptacle 376, thereby allowing portions of the cable 402 to be routed through the aperture 394 and into the space 380 formed between the receptacle 376 and the upper 100, as shown in FIGS. 1 and 2. Put another way, the aperture 394 is formed through a thickness of the leg 378 and provides access to the space 380 formed between the legs 378.

Optionally, the flanges 392 may each include a relief 396 for attaching the cradle 372 to the upper 100. In the illustrated example, the relief 396 includes a portion of the flange 392 having a reduced thickness, whereby the flange 392 can be attached to the upper 100 by stitching or sewing through the relief 396. In addition to the reliefs 396 in the flanges 392, the cable lock 300 may optionally include corresponding apertures 398*a*-398*c* respectively formed through the lock device 302, the cradle 372, and the lid 374. When the cable lock 300 is assembled, the respective apertures 398*a*-398*c* of each of the components align with each other to provide an opening extending continuously through the cable lock 300. Here, the components of the cable lock 300 may be attached to each other and/or to the upper 100 through the apertures 398*a*-398*c*.

FIG. 10 provides a top view of the cable lock 300 with the cover 308 removed to show the locking member 310, release cord 370, and cable 402 disposed within the locking channel 328 of the housing 306 while in the locked state. In some examples, the locking member 310 is biased into the locked state by the first biasing member 312. For instance, FIG. 10 shows the first biasing member 312 exerting the engaging force $F_E$ upon the locking member 310 to urge the second end 354 of the locking member 310 toward the second end 318 of the housing 306, and thereby bias the locking member 310 into the locked state.

While in the locked state, the locking member 310 restricts movement of the cable 402 relative to the housing 306 by pinching the cable 402 between the engagement surfaces 330 and the lock surfaces 356. Accordingly, the locked state of the locking member 310 restricts the cable 402 from moving in the loosening direction $D_L$ when the loosening force $F_L$ is applied to the cable 402. In the example shown, the locking member 310 permits movement of the cable 402 when the tightening force $F_T$ is applied to a control element 406 of the cable 402, as this direction causes the cable 402 to apply a force on the locking member 310 due to the generally wedge shape of the locking member 310, thereby moving the locking member 310 towards the unlocked state. The locking member 310 automatically returns towards the locked state once the force applied to the control element 406 is released due to the forces imparted on the locking member 310 by the first biasing member 312.

FIG. 11 provides a top view of the cable lock 300 with the cover 308 removed to show the locking member 310 disposed within the locking channel 328 of the housing 306 while in the unlocked state. In some examples, the release cord 370 attached to the tab 360 of the locking member 310 applies the release force $F_R$ upon the locking member 310 to move the locking member 310 away from the engagement surfaces 330. Here, the release force $F_R$ is sufficient to overcome the engaging force $F_E$ of the first biasing member 312 to permit the locking member 310 to move relative to the housing 306 such that the pinching upon the locking segments 420, 422 of the cable 402 between the lock surfaces 356 and the engagement surfaces 330 is released. In some examples, the engaging force $F_E$ causes the locking member 310 to transition back toward the locked state when the release force $F_R$ applied by the release cord 370 is removed.

While in the unlocked state, the locking member 310 permits movement of the cable 402 relative to the housing 306 by allowing the locking segments 420, 422 of the cable 402 to freely move between the respective lock surfaces 356 and the engagement surfaces 330. The unlocked state of the locking member 310 permits movement of the cable 402 in both the tightening direction $D_T$ and the loosening direction $D_L$ when the pulling forces $F_T$, $F_L$ are applied to respective ones of the control element 406 and a fastening element 408 of the cable 402. Movement of the cable 402 in the tightening direction $D_T$ causes the effective length of the fastening element 408 to decrease to constrict the throat 108 of the upper 100 and thereby move the upper 100 into the constricted state for closing the interior void 102 around the foot, while movement of the cable 402 in the loosening direction $D_L$ causes an effective length of the fastening element 408 to increase to allow the throat 108 to revert back to their flat relaxed states and thereby facilitate a transition of the upper 100 from the constricted state to the relaxed state such that the foot can be removed from the interior void 102.

In some examples, a sufficient magnitude and/or duration of the release force $F_R$ applied to the release cord 370 causes the release cord 370 to apply the release force $F_R$ upon the locking member 310 in a direction opposite the direction of the engaging force $F_E$ such that the locking member 310 moves away from the engagement surfaces 330 relative to the housing 306 and toward the first end 316 of the housing 306. At least one of the retention features 334 of the housing 306 may engage the detent 364 of the locking member 310 when release force $F_R$ moves the locking member 310 a predetermined distance away from the engagement surfaces 330 of the housing 306, as shown in FIG. 11. Here, engagement between the detents 364 of the locking member 310 and the at least one retention feature 334 of the housing 306 maintains the locking member 310 in the unlocked state once the release force $F_R$ is released. The engaging force $F_E$ of the first biasing member 312 and the forces exerted by the pair of second biasing members 314 on the retention features 334 lock the projections 344 of the retention features 334 into engagement with the detents 364 of the locking member 310 after the locking member 310 moves the predetermined distance and the release force $F_R$ is no longer applied.

In some scenarios, a release force $F_R$ associated with a first magnitude may be applied to the release cord 370 to move the locking member 310 away from the engagement surfaces 330 by a distance less than the predetermined distance such that the retention features 334 do not engage. In these scenarios, the release force $F_R$ associated with the first magnitude can be maintained when it is desirable to move the cable 402 in the loosening direction $D_L$ (e.g., by applying the loosening force $F_L$ to the fastening element 408) or the tightening direction $D_T$ (e.g., by applying the tightening force $F_T$ to the control element 406) for adjusting the fit of the interior void 102 around the foot. Once the desired fit of the interior void 102 around the foot is achieved, the release force $F_R$ can be released to cause the locking member 310 to transition back to the locked state so that movement of the cable 402 is restricted in the loosening direction $D_L$ and the desired fit can be sustained. It should be noted that even when the locking member 310 is in the locked state, the cable 402 can be moved in the tightening direction $D_T$. As such, once the loosening force $F_L$ is released and a desired fit is achieved, the locking member 310 automatically retains the desired fit by locking a position of the cable 402 relative to the housing 306.

In other scenarios, a release force $F_R$ associated with a second magnitude greater than the first magnitude can be applied to the release cord 370 to move the locking member 310 the predetermined distance away from the engagement surfaces 330 to cause the corresponding retention features 334 to engage the detents 364. Engagement of the retention features 334 is facilitated by providing the projections 344 of the retention features 334 with a tapered biasing surface 348 that opposes the locking member 310 to allow the locking member 310 to more easily move the retention features 334 against the biasing force $F_B$ imparted thereon by the second biasing members 314 when the release cord 370 is pulled the predetermined distance. In these scenarios, engagement between the corresponding retention features 334 and the detents 364 maintains the locking member 310 in the unlocked state when the release force $F_R$ is released, as shown in FIG. 11.

The locking member 310 is returned to the locked state when a tightening force $F_T$ is applied to the control element 406. Namely, when the tightening force $F_T$ is applied to control element 406, the first control segment 412 and the second control segment 414 are placed in tension which, in turn, exerts a force on the second biasing members 314 via the distal ends 340 of the tab 336 of the retention features 334, as the first control segment 412 and the second control segment 414 pass through the first openings 326*a*, as shown in FIGS. 10 and 11. In so doing, the distal ends 340 of the retention features 334 compress the second biasing members 314 and, as such, cause the projections 344 of the retention features 334 to move away from one another and disengage the detents 364 of the locking member 310, thereby allowing the first biasing member 312 to return the locking member 310 to the locked state.

Turning now to FIGS. 1 and 2, the tensioning system 400 includes the cable 402 and a tracking system 404 formed on or in the upper 100 and the sole structure 200 for routing the cable 402 and distributing tension of the cable 402 along the article of footwear 10. As illustrated in FIG. 1, application of each of the tightening force $F_T$ and the loosening force $F_L$ to the respective control element 406 and the fastening element 408 causes a tensile force to be imparted along the length of the cable 402. Generally, as one of the tightening force $F_T$ or the loosening force $F_L$ is applied to the cable 402, the tracking system 404 distributes the tension of the cable 402 along a plurality of points along the throat 108 to constrict or relax the throat 108, as discussed in greater detail below.

The cable 402 may be highly lubricous and/or may be formed from one or more fibers having a low modulus of elasticity and a high tensile strength. For instance, the fibers may include high modulus polyethylene fibers having a high strength-to-weight ratio and a low elasticity. Additionally or alternatively, the cable 402 may be formed from a molded monofilament polymer and/or a woven steel with or without other lubrication coating. In some examples, the cable 402 includes multiple strands of material woven together.

In the illustrated examples, the cable 402 includes the control element 406 extending in a first direction from the cable lock 300, the fastening element 408 extending in a second direction from the cable lock 300, and a locking portion 410 (FIG. 9) connecting the control element 406 and the fastening elements 408. The control element 406 is configured to have a tightening force $F_T$ applied thereto to move the cable 402 in the tightening direction $D_T$. When incorporated into the article of footwear 10, the control element 406 may be arranged on the article of footwear 10 so that it can be easily grasped by the user to pull the cable 402 in the tightening direction $D_T$. The fastening element 408 is configured to cooperate with the tracking system 404 to tighten the article of footwear 10 when the tightening force $F_T$ is applied to the control element 406. Conversely, the fastening element 408 is also configured to have a loosening force $F_L$ applied thereto to move the cable 402 in the loosening direction $D_L$. In the illustrated example, the loosening force $F_L$ may be indirectly applied to the fastening element 408 by pulling on one of the grips 122, 438 of the footwear 10. The locking portion 410 is disposed within the cable lock 300 and interfaces with the cable lock 300 to secure the position of the cable 402, as described above.

With reference to FIGS. 1 and 9, the cable 402 may include various segments defined in relation to the cable lock 300. For example, the control element 406 may be described as including a first control segment 412 and a second control segment 414, which are independently operable to control a tension of corresponding fastening segments 416, 418 of the fastening element 408, as discussed below. In the illustrated example, the first control segment 412 and the second control segment 414 each extend from the first openings 326*a* at an anterior end of the cable lock 300 and towards the posterior end 14 of the upper 100 along opposite sides 16, 18. In some examples, the control element 406 is formed as a continuous loop, whereby respective "ends" of the first control segment 412 and the second control segment 414 are joined to each other such that the control element 406 forms a continuous length of the cable 402 extending from the cable lock 300. In the example of FIG. 1, where the cable lock 300 is disposed on the tongue 114 of the upper 100, the first control segment 412 is generally disposed along the lateral side 16 of the upper 100 while the second control segment 414 is generally disposed along the medial side 18 of the upper 100 and attaches or joins to the first control segment 412 in a central portion of the upper 100, adjacent to the heel counter 118.

Likewise, the fastening element 408 may include a first fastening segment 416 and a second fastening segment 418. The first fastening segment 416 extends from the cable lock 300 on the tongue 114 of the upper 100 and is routed in a serpentine manner along the throat 108. The second fastening segment 418 extends from the cable lock 300 on the tongue 114 of the upper 100 and is routed in a serpentine manner along the throat 108. In contrast to the continuously formed control element 406, the fastening element 408 is not continuous such that each of the fastening segments 416, 418 include terminal ends 424 anchored to the upper 100. As discussed in greater detail below, the terminal ends 424 may attach to the upper 100 at discrete locations from each other. Alternatively, the terminal ends 424 may connect to one another at another area of the footwear 10.

While an overall length of the cable 402 is constant, effective lengths of the control element 406 and the fastening element 408 of the cable 402 depend upon the position of the cable 402 with respect to the cable lock 300. For example, when the control element 406 is pulled and the cable 402 moves in the tightening direction $D_T$ through the cable lock 300, the effective length of the control element 406 will increase and the effective length of the fastening element 408 will decrease. Conversely, when the fastening element 408 is pulled and the cable 402 moves in the loosening direction $D_L$ through the cable lock 300, the effective length of the fastening element 408 will increase to loosen the article of footwear 10 and the effective length of the control element 406 will decrease. As provided above, the locking portion 410 refers to the portion of the cable 402 that is contained within the cable lock 300 regardless of the position of the cable 402. Accordingly, the control element 406, the fastening element 408, and the locking portion 410 are not fixed sections of the cable 402 itself, but depend on the position of the cable 402 with respect to the cable lock 300.

The cable 402 of the tensioning system 400 is configured to cooperate with the cable lock 300 to move the article of footwear 10 between a constricted state and a relaxed state, as described in greater detail below. In some examples, at least one of the lateral side 16 and the medial side 18 of the upper 100 include a series of the cable guides 426 that route the fastening element 408 of the cable 402 along the throat 108. In the illustrated examples, the cable guides 426 of the tracking system 404 are formed by fabric or mesh loops through the shroud 124, which define a passage for slidably receiving the cable 402 therethrough. In other examples, the cable guides 426 may include apertures (e.g., eyelets) formed through the upper 100, or fabric or mesh loops attached to the upper 100 to receive the fastening segments 416, 418. Fabric or mesh loops/webbing may generate friction with the cable 402 when the cable 402 moves in the tightening direction $D_T$. A maximum number of fabric or mesh loops for use as the cable guides 426 may be selected to not exceed a threshold number of turns of the cable 402 so that cumulative friction does not detrimentally inhibit movement by the cable 402 in the tightening direction $D_T$.

Figure 5B:
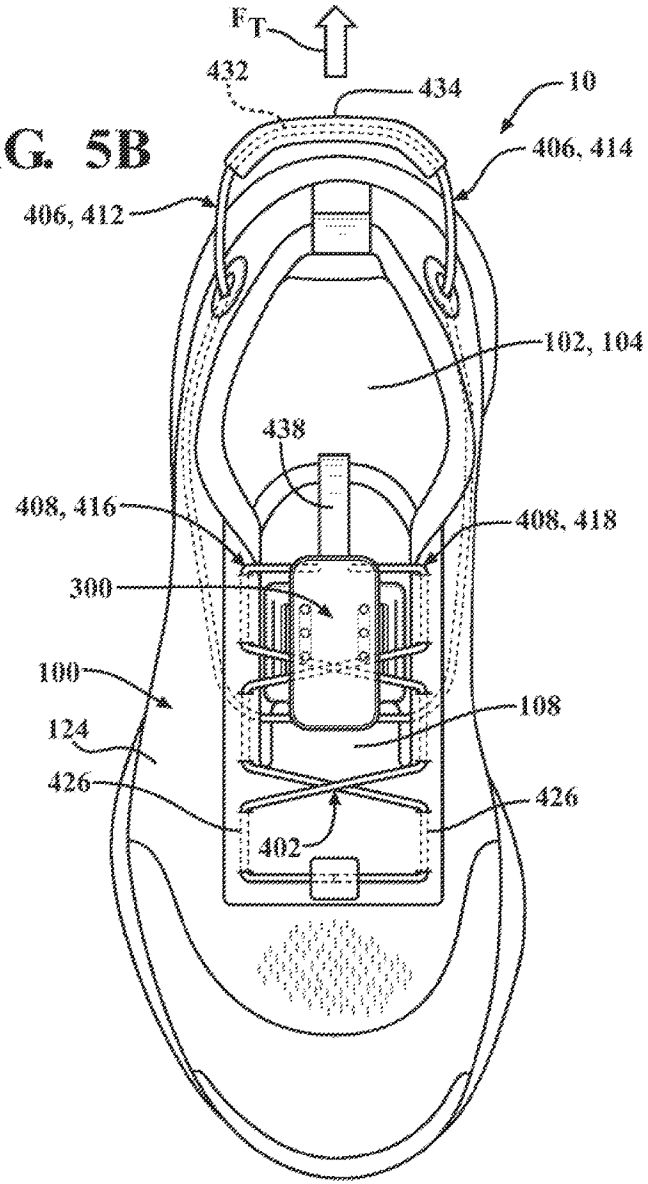
FIGS. 5A-5D are top plan views of the article of footwear of FIG. 1, respectively showing the article of footwear in a loosened state, a tightening state, a tightened state, and a loosening state.
Figure 5A:
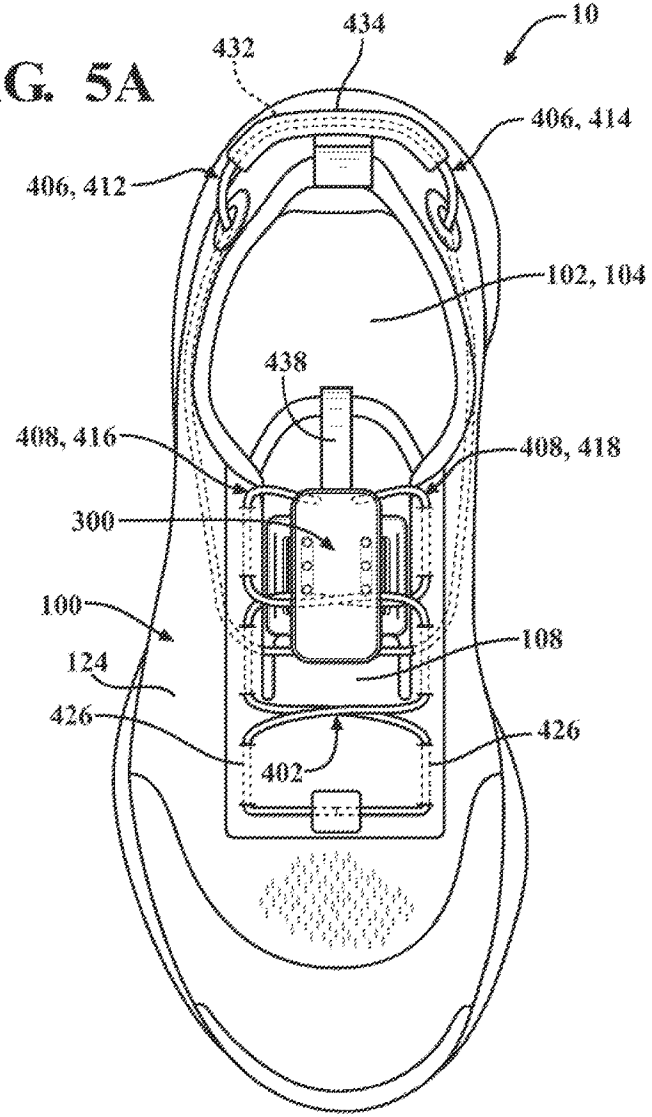

With reference to FIG. 5A, the first fastening segment 416 and the second fastening segment 418 route through a plurality of the cable guides 426 disposed along the throat 108 of the upper 100. After routing through the cable guides 426, the terminal ends 424 of the first fastening segment 416 and the second fastening segment 418 are attached to the upper 100. In the illustrated examples, the terminal ends 424 are attached to the upper 100 at discrete attachment points 428 adjacent to an anterior end of the throat 108. In other examples, the terminal ends 424 may operatively connect to one another at a single attachment point. For instance, a connector may connect the terminal ends 424 to one another or the terminal ends 424 may be knotted together, adhesively bonded to each other, or fused together.

In the illustrated example, the first fastening segment 416 and the second fastening segment 418 cooperate to control a tightness of the upper 100 along the throat 108. As shown, the first fastening segment 416 extends from the cable lock 300 to a first one of the cable guides 426 disposed on the lateral side 16 of the throat 108 adjacent to the collar 120. From the first one of the cable guides 426, the first fastening segment 416 is routed across the throat 108 through the space 380 formed between the receptacle 376 and the upper 100 to a second one of the cable guides 426 on the medial side 18 of the throat 108. Thus, the first fastening segment 416 passes beneath the receptacle 376 through the apertures 394 formed in each of the legs 378 of the cable lock 300. From the second one of the cable guides 426 on the medial side 18, the first fastening segment extends back across the throat 108 to another cable guide 426 on the lateral side 16, and is then routed to the attachment point 428 at the anterior end of the throat 108.

The second fastening segment 418 extends from the cable lock 300 to a first one of the cable guides 426 disposed on the medial side 18 of the throat 108 adjacent to the collar 120. From the first one of the cable guides 426, the second fastening segment 418 is routed across the throat 108 through the space 380 formed between the receptacle 376 and the upper 100 to a second one of the cable guides 426 on the lateral side 16 of the throat 108. Thus, the second fastening segment 418 passes beneath the receptacle 376 through the apertures 394 formed in each of the legs 378 of the cable lock 300. From the second one of the cable guides 426 on the lateral side 16, the second fastening segment 418 extends across the throat 108 to another cable guide 426 on the medial side 18, and is then routed to the attachment point 428 at an anterior end of the throat 108. Thus, the second fastening segment 418 is routed similar to the first fastening segment 416, but along opposite sides of the throat 108. Accordingly, the first fastening segment 416 and the second fastening segment 418 cooperate to control the state (e.g., relaxed, constricted) of the throat 108.

Figure 4:
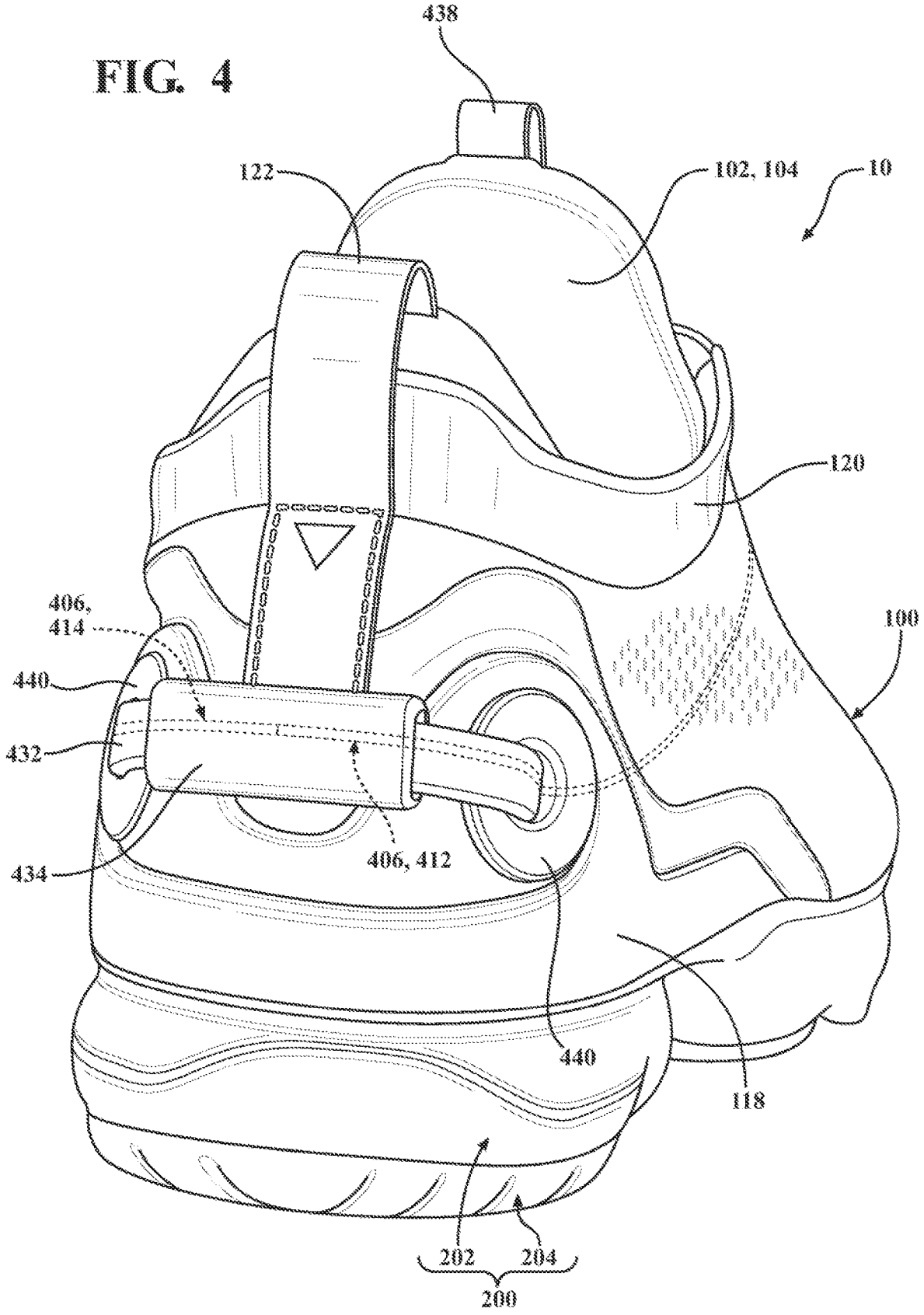
FIG. 4 is a rear elevation view of the article of footwear of FIG. 1.

The tensioning system 400 may further include one or more passages 430 for routing the cable 402 along the upper 100. The passages 430 may be formed within the upper 100, or alternatively, the passages 430 may be defined by a sheath or cover attached to an outer surface of the upper 100. In the illustrated example, the first control segment 412 and the second control segment 414 are routed through a passage 430 formed within or beneath the shroud 124 along each of the lateral side 16 and the medial side 18. As shown in FIG. 1, the passage 430 extends from the throat 108 adjacent to the cable lock 300, and along the lateral quarter panel 106 and the lateral heel side panel 116 to an outlet 440 on the heel counter 118. A similar passage 430 extends along the medial side 18 from the cable lock 300 to an outlet 440 on the medial side 18 of the heel counter 118, as shown in FIG. 4.

As provided above, the control element 406 of the cable 402 is a continuous loop extending from the cable lock 300. As shown in FIGS. 1-4, the control element 406 extends around heel counter 118. The portion of the control element 406 that extends around the heel counter 118 may be enclosed within one or more sheaths 432. Each sheath 432 may additionally be formed from a material and/or a weave that allows the sheath 432 and control element 406 of the cable 402 to move from a relaxed state to a stretched or expanded state when the control element 406 is moved in a direction away from the upper 100 by way of the tightening force $F_T$ (i.e., when the cable 402 is moved in the tightening direction $D_T$). When the tightening force $F_T$ is removed, the material and/or weave of the sheath 432 automatically causes the sheath 432 to contract to the relaxed state and accommodate bunching by the cable 402 therein.

In the example shown, a separate control portion grip 434 operatively connects to the sheath 432 at an attachment location proximate to the posterior end 14 to allow a user to apply the tightening force $F_T$ to pull the control element 406 away from the upper 100, and thereby constrict the throat 108 by simultaneously pulling opposite sides of the throat 108 toward one another to move the upper 100 into the constricted state. Other configurations may include operatively connecting the control portion grip 434 to other portions of the sheath 432 along the length of the control element 406. In some implementations, the control portion grip 434 is omitted and the sheath 432 corresponds to the control element 406 by allowing a user to grasp and apply the tightening force $F_T$ to pull the control element 406 away from the upper 100.

With reference to FIGS. 5A-5D, the use of the cable lock 300 and tensioning system 400 in conjunction with the upper 100 is illustrated. FIG. 5A shows an example of the footwear 10 in a relaxed or loosened state, whereby the first fastening segment 416 and the second fastening segment 418 are provided with slack and the throat 108 is in a relaxed state. In the relaxed state, a foot of a wearer can be inserted into the interior void 102 of the upper 100 via the ankle opening 104. The slack within the fastening segments 416, 418 allows the throat 108 to move to a stretched or expanded state, thereby increasing an effective volume of the interior void 102 to accommodate the foot of the wearer. The throat 108 and the tongue 114 may be formed of elastic materials to provide a first degree of constriction to the foot of the wearer to maintain the footwear 10 on the foot prior to transitioning the footwear to the constricted or tightened state.

As shown in FIG. 5B, the footwear 10 can be moved to a constricted state by pulling the control element 406. For example, as the control element 406 is pulled away from heel counter 118, first tightening force $F_T$ is applied to the first control segment 412 and the second control segment 414. The tightening force $F_T$ causes the first locking segment 420 and the second locking segment 422 of the cable 402 to be pulled through the cable lock 300 a first distance as the tightening force $F_T$ is transmitted from the control segments 412, 414 to the respective fastening segments 416, 418. Application of the tightening force $F_T$ to the fastening segments 416, 418 draws the cable guides 426 along opposite sides of the throat 108 towards each other, thereby constricting the throat 108 of the upper 100 around the foot of the wearer. By constricting the throat 108, the amount that the elastic material of the throat 108 or tongue 114 is able to stretch is effectively limited by the fastening element 408. A magnitude of the first tightening force $F_T$ can be selected based on a desired amount of stretch to be allowed in the throat 108 and tongue 114.

Figure 5D:
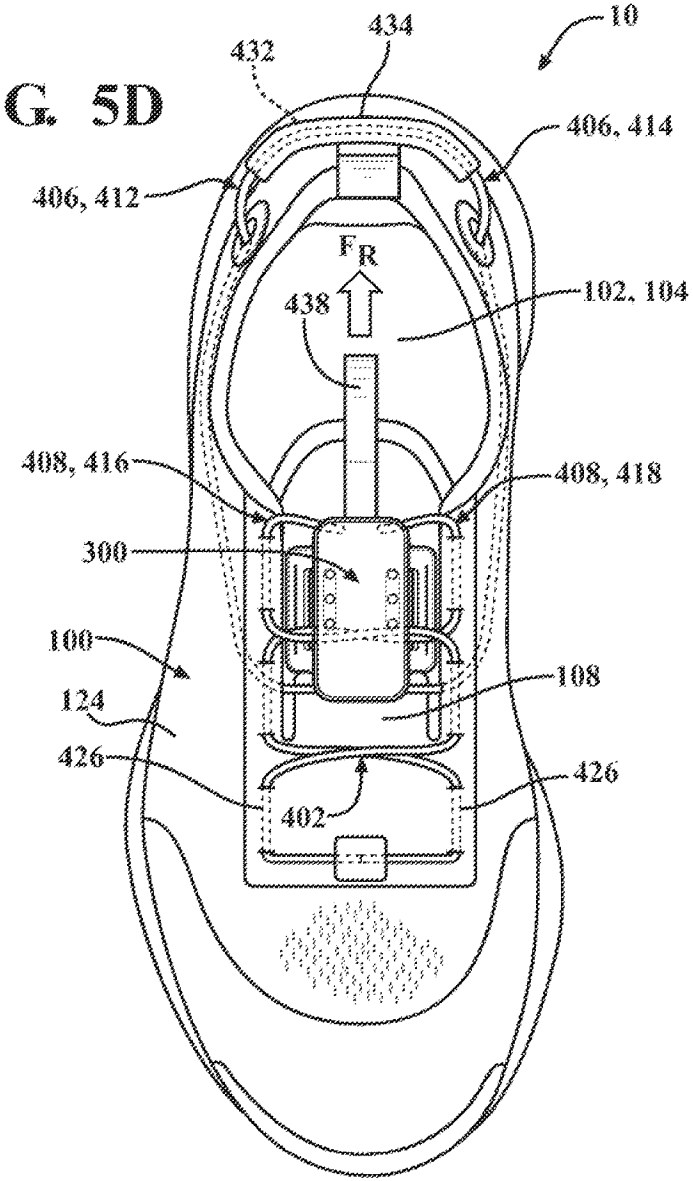
Figure 5C:
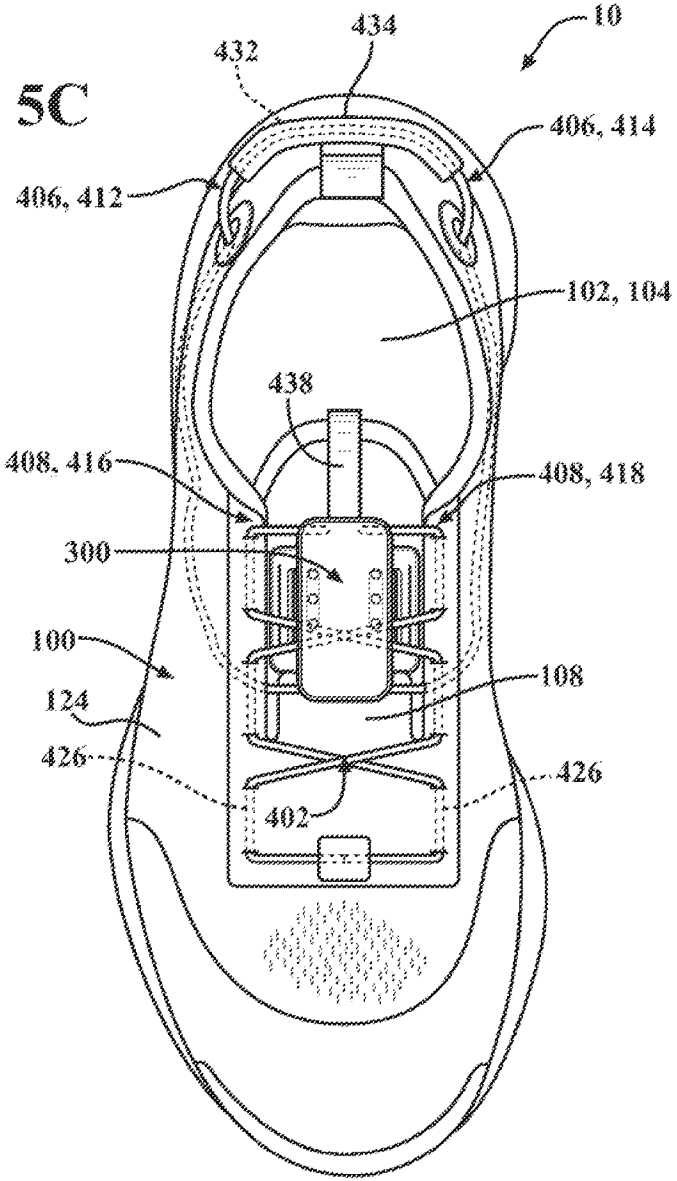

At FIG. 5C, the footwear 10 is shown in the constricted state with the cable lock 300 in the locked state. As discussed above, in the constricted state, the effective length of the control element 406 is increased by pulling the control element 406, thereby reducing the effective length of the fastening element 408 along the throat 108 to constrict the throat 108. Here, the additional length of the control element 406 is accommodated by the sheath 432. For example, the control element 406 may be contained within the elastic sheath 432, such that when the control element 406 is in the extended state and the tightening force $F_T$ is released, the sheath 432 contracts and the additional length of the control element 406 is bunched within the sheath 432. In some examples, the sheath 432 may be routed within the shroud 124 such that the control element 406 can bunch beneath the shroud 124.

When the footwear 10 is configured in the constricted state, as shown in FIG. 5C, the cable lock 300 is configured in the locked state (FIG. 10) to prevent the cable 402 from moving in the loosening direction $D_L$. Thus, to return the footwear 10 to a relaxed state, the cable lock 300 must be unlocked by applying the release force $F_R$ to the release cord 370, as discussed above. In the illustrated example, the release cord 370 is connected to the release grip 438, which is routed through the cable lock 300 and extends from the tongue 114 adjacent to the ankle opening 104. As shown in FIG. 5D, the release force $F_R$ can be applied to the release grip 438 by pulling the release grip 438 away from the cable lock 300. The release force $F_R$ biases the cable lock 300 to the unlocked state (FIG. 11) so that the cable 402 can move in the loosening direction $D_L$ through the lock device 302.

The following Clauses provide an exemplary configuration for a cable lock and an article of footwear described above.

Clause 1: An article of footwear comprising: an upper; a cable lock disposed adjacent to an exterior surface of the upper, the cable lock separated from the exterior surface of the upper by a space; and a cable having a first portion routed through the cable lock and a second portion routed through the space between the cable lock and the upper, the cable operable to move the upper between a relaxed state and a constricted state.

Clause 2: The article of footwear of Clause 1, wherein the cable lock includes one or more legs extending therefrom, the cable lock supported against the upper by each of the one or more legs.

Clause 3: The article of footwear of Clause 2, wherein each of the legs includes a flange disposed against the upper.

Clause 4: The article of footwear of Clause 3, wherein the flange of each of the one or more legs is attached to the upper.

Clause 5: The article of footwear of any of Clauses 2-4, wherein each of the legs includes an aperture formed therethrough.

Clause 6: The article of footwear of Clause 5, wherein the aperture is in communication with the space.

Clause 7: The article of footwear of any of Clauses 5 or 6, wherein the cable is routed through the aperture of each of the one or more legs.

Clause 8: The article of footwear of any of Clauses 1-7, wherein the cable lock is disposed on a throat of the upper.

Clause 9: The article of footwear of any of Clauses 1-8, wherein the cable includes a control element and a fastening element, the control element extending from the cable lock and around a heel region of the article of footwear and the fastening element extending along a throat of the upper.

Clause 10: The article of footwear of any of Clauses 1-9, wherein the upper includes a release grip attached to a throat of the upper adjacent to an ankle opening, the release grip operable to move the cable lock from a locked state to an unlocked state.

Clause 11: An article of footwear comprising: an upper including an ankle opening and a tongue portion disposed adjacent to the ankle opening; a cable lock disposed adjacent to the tongue portion of the upper; a cable having a first portion routed through the cable lock and a second portion routed through a space between the cable lock and the tongue portion, the cable operable to move the upper between a relaxed state and a constricted state; and a release grip extending from the cable lock adjacent to the ankle opening and operable to move the cable lock from a locked state to an unlocked state.

Clause 12: The article of footwear of Clause 11, wherein the cable lock includes one or more legs extending therefrom, the cable lock supported against the upper by each of the one or more legs to define the space between the cable lock and the upper.

Clause 13: The article of footwear of Clause 12, wherein each of the legs includes a flange disposed against the upper.

Clause 14: The article of footwear of Clause 13, wherein the flange of each of the one or more legs is attached to the upper.

Clause 15: The article of footwear of any of Clauses 12-14, wherein each of the legs includes an aperture formed therethrough.

Clause 16: The article of footwear of Clause 15, wherein the aperture is in communication with the space.

Clause 17: The article of footwear of any of Clauses 15 or 16, wherein the cable is routed through the aperture of each of the one or more legs.

Clause 18: The article of footwear of any of Clauses 11-17, wherein the cable lock is disposed on a throat of the upper.

Clause 19: The article of footwear of any of Clauses 1-18, wherein the cable includes a control element and a fastening element, the control element extending from the cable lock and around a heel region of the article of footwear and the fastening element extending along a throat of the upper.

Clause 20: The article of footwear of any of Clauses 11-19, wherein cable lock includes a release cord having a first end connected to the cable lock and a second end connected to the release grip.

Clause 21: A cable lock for an article of footwear, the cable lock comprising: a cartridge including a receptacle and one or more legs extending from the receptacle; and a lock device removably received within the receptacle, the lock device operable between an unlocked state to allow a cable to move through the lock device in a tightening direction and a loosening direction and in a locked state to prevent the cable from moving through the lock device in the loosening direction.

Clause 22: The cable lock of Clause 21, wherein the receptacle includes a bottom wall and one or more sidewalls, each of the one or more legs extending from the one or more sidewalls to a distal end beyond the bottom wall.

Clause 23: The cable lock of Clause 22, wherein the distal end of each of the legs includes a flange.

Clause 24: The cable lock of Clause 23, wherein the flange is parallel to and offset from the bottom wall of the receptacle.

Clause 25: The cable lock of any of Clauses 22-24, wherein the one or more legs includes a pair of the legs disposed on opposite sides of the receptacle and defining a space along the bottom wall.

Clause 26: The cable lock of Clause 35, wherein each of the legs includes an aperture in communication with the space.

Clause 27: The cable lock of any of Clauses 21-26, wherein the receptacle includes a chamber configured to receive the lock device, the chamber including a pair of shoulders upon which the lock device is supported.

Clause 28: The cable lock of Clause 27, wherein the shoulders are spaced apart from each other to define a channel extending between the lock device and the receptacle.

Clause 29: The cable lock of Clause 28, wherein the lock device includes a release cord operable to move the lock device from a locked state to an unlocked state, the release cord routed through the channel.

Clause 30: The cable lock of Clause 29, further comprising a lid configured to enclose the lock device within the receptacle.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A cable lock for an article of footwear, the cable lock comprising:

a cartridge including a receptacle and one or more legs, the one or more legs attached to and extending from the receptacle forming a gap between the receptacle and the one or more legs; and a lock device removably received within the receptacle, the lock device operable between an unlocked state to allow a cable to move through the lock device in a tightening direction and a loosening direction and in a locked state to prevent the cable from moving through the lock device in the loosening direction, wherein the receptacle further includes:

a chamber, extending from a first end to a second end disposed opposite the first end, configured to receive the lock device, the chamber including a pair of peripheral walls extending along a length of the chamber from the first end to the second end, and the chamber including an end wall extending along a width of the chamber connecting the pair of peripheral walls at the second end of the chamber, the chamber further including a pair of shoulders each having a longitudinal surface extending parallel with the pair of peripheral walls from the first end of the chamber the second end of the chamber, the longitudinal surfaces being laterally spaced apart from each other to define a first width of a channel extending laterally between the pair of shoulders, each pair of shoulders having an end surface transverse to the longitudinal surface and defining a portion of the channel having a second width that is wider than the first width, wherein the lock device is continuously supported by the pair of shoulders from the first end of the chamber to the second end of the chamber.

2. The cable lock of claim 1, wherein the receptacle includes a bottom wall and one or more sidewalls, each of the one or more legs extending from the one or more sidewalls to a distal end beyond the bottom wall.

3. The cable lock of claim 2, wherein the distal end of each of the legs includes a flange.

4. The cable lock of claim 3, wherein the cable lock is supported against an upper of the article of footwear by each of the one or more legs to define the gap between the cable lock and the upper.

5. The cable lock of claim 4, wherein the flange of each of the one or more legs is attached to the upper.

6. The cable lock of claim 3, wherein the flange is parallel to and offset from the bottom wall of the receptacle.

7. The cable lock of claim 2, wherein the one or more legs includes a pair of the legs disposed on opposite sides of the receptacle and defining a space along the bottom wall.

8. The cable lock of claim 7, wherein each of the legs includes an aperture in communication with the space.

9. The cable lock of claim 8, wherein a cable is routed through the aperture of each of the one or more legs.

10. The cable lock of claim 1, wherein the pair of shoulders support the lock device.

11. The cable lock of claim 1, wherein the lock device includes a release cord operable to move the lock device from a locked state to an unlocked state, the release cord routed through the channel, and wherein the lock device further includes a lid configured to enclose the lock device within the receptacle.

12. The cable lock of claim 1, wherein an upper of the article of footwear includes one or more outlets disposed on an exterior surface of the upper, and wherein the one or more outlets provide a passage for routing the cable and a release grip from an interior surface of the upper to the exterior surface of the upper.

* * * * *